US005189434A

United States Patent [19]

Bell

[11] Patent Number: 5,189,434

[45] Date of Patent: Feb. 23, 1993

[54] MULTI-MODE ANTENNA SYSTEM HAVING PLURAL RADIATORS COUPLED VIA HYBRID CIRCUIT MODULES

[75] Inventor: Ross L. Bell, Mineral Wells, Tex.

[73] Assignee: Antenna Products Corp., Mineral Wells, Tex.

[21] Appl. No.: 326,746

[22] Filed: Mar. 21, 1989

[51] Int. Cl.[5] ..... H01Q 25/04; H01P 5/16

[52] U.S. Cl. ..... 343/853; 343/895; 343/859; 333/25; 333/117

[58] Field of Search ..... 333/117-119, 333/131, 25; 343/895, 850, 852, 853, 858, 859, 725-727, 797, 729

[56] References Cited

U.S. PATENT DOCUMENTS

| | | | |
|---|---|---|---|
| 2,508,648 | 5/1950 | O'Brien et al. | 343/840 |
| 2,894,124 | 7/1959 | Himmel et al. | 343/853 X |
| 3,019,439 | 1/1962 | Reis et al. | 343/853 |
| 3,039,099 | 6/1962 | Chait et al. | 343/895 X |
| 3,226,724 | 12/1965 | Brueckmann | 343/853 |
| 3,317,849 | 5/1967 | Smith-Vaniz | 333/117 X |
| 3,419,873 | 12/1968 | Tonner et al. | 343/729 X |
| 3,503,016 | 3/1970 | Podell | 333/119 |
| 3,641,578 | 2/1972 | Spanos et al. | 333/117 X |
| 3,906,514 | 9/1975 | Phelan | 343/895 |
| 4,121,180 | 10/1978 | Greenway | 333/25 X |
| 4,498,084 | 2/1985 | Werner et al. | 343/895 X |
| 4,635,070 | 1/1987 | Hoover | 343/895 X |

*Primary Examiner*—Eugene R. LaRoche
*Assistant Examiner*—Benny T. Lee
*Attorney, Agent, or Firm*—Charles W. McHugh

[57] ABSTRACT

A hybrid circuit module having first and second pairs of input terminals and four output terminals. First, second, third and fourth baluns each include first and second transmission line wires. The baluns are configured between the input and output terminals to isolate sources when placed across pairs of input and output terminals. An antenna system is formed with the hybrid circuit module and a plurality of radiators. The circuit module may be configured to simultaneously generate or receive two or more independent radiation patterns. A method is provided for feeding a multiarm antenna structure with a hybrid circuit network. The method includes the steps of symmetrically positioning a conductive element with respect to all of the arms, and coupling terminals of the antenna arms to the network through a conductive element. Alternately the second terminals may be electromagnetically coupled to the network without requiring the conductive element. Generally the invention enables simultaneously feeding of antenna arms with two or more independent signals in order to transmit or receive multiple independent radiation patterns.

42 Claims, 14 Drawing Sheets

FIG. 10
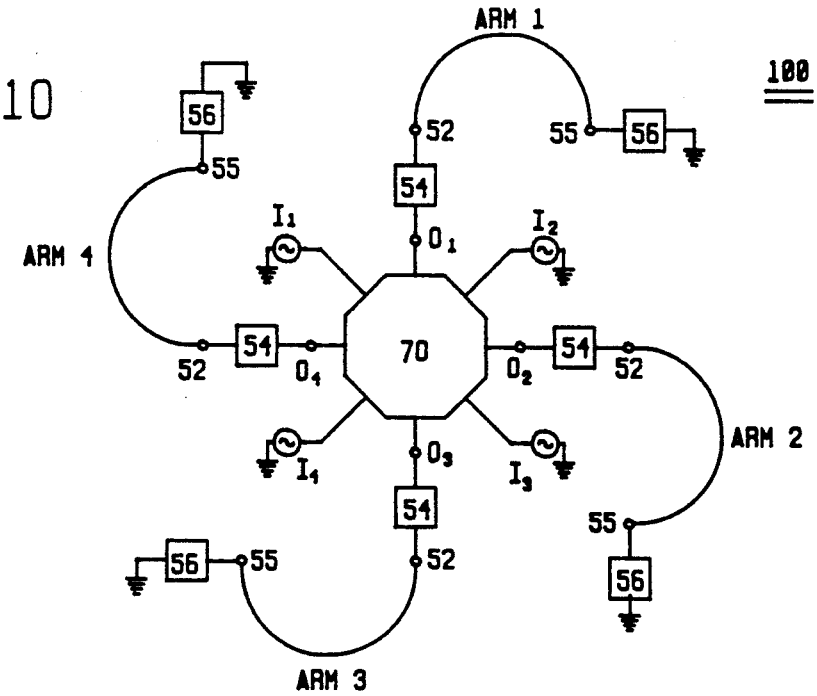
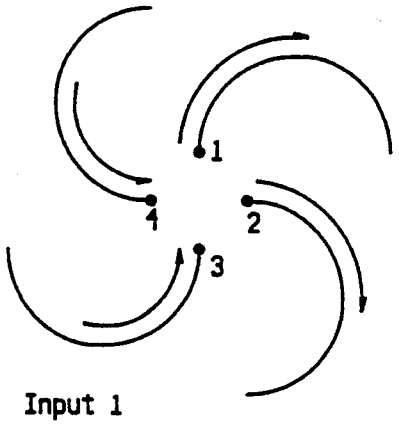
FIG. 11A
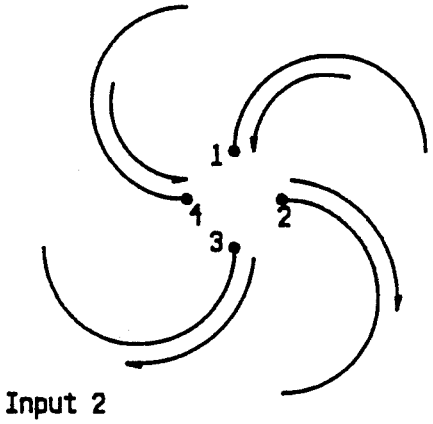
FIG. 11B
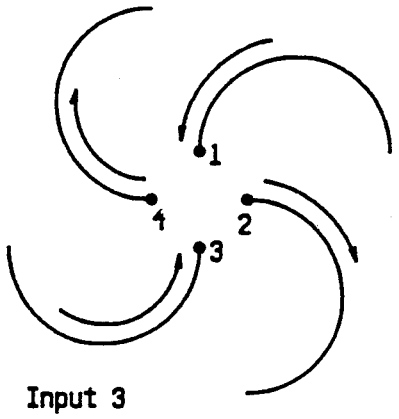
FIG. 11C
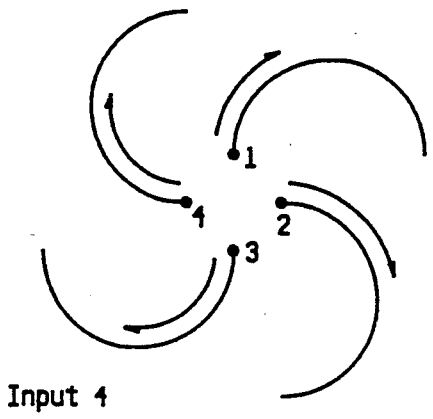
FIG. 11D

MULTI-MODE ANTENNA SYSTEM HAVING PLURAL RADIATORS COUPLED VIA HYBRID CIRCUIT MODULES

The present invention relates generally to antenna systems. In particular, the invention may be applied to broad band systems of the type formed with an array of radiators; and the invention also relates to antennas capable of providing multiple modes of operation.

Log periodic antennas having two or more arms, e.g., dipole, planar spiral or conical spiral configurations, are capable of providing multiple modes of operation over wide frequency ranges such as 2 to 30 MHz. Generally, it is advantageous to employ conical log spiral antennas because they provide omnidirectional patterns without requiring cavities or reflectors. Furthermore, multiple-arm antennas are capable of transmitting in more than one radiation pattern and selectively receiving rf signals which differ in polarization and/or spatial orientation.

For example, the two-arm conical spiral antenna, Model ST-230, manufactured by Antenna Products Corp. of Mineral Wells, Texas simultaneously provides high angle (odd) and low angle (even) modes of operation with two independent sources. That is, a high angle four-arm, primarily horizontally polarized pattern is produced as well as a low angle, primarily vertically polarized pattern. Alternately, the Model ST-230 can simultaneously transmit and receive two signals. Generally, for two-arm radiating structures, this simultaneous operation is effected with a hybrid feed network that couples both arms to both sources.

It is well known that antennas comprising four orthogonal radiating arms have the potential for radiating in a greater number of modes than two-arm structures. According to theoretical computations it is possible to obtain up to $N-1$ orthogonal modes of operation in an N-arm spiral antenna. See, for example, Johnson and Jasik, *The Antenna Engineering Handbook*, 2d Ed. (1984), incorporated herein by reference, at Chapter 14. An early dual-mode design for the four-arm conical log spiral antenna is disclosed in U.S. Pat. No. 4,498,084 to Werner et al.; it incorporates a switch for alternately connecting one source to all of the antenna radiating elements in either of two configurations. This arrangement enables operation of the four-arm antenna in a high angle, predominantly horizontally polarized mode, or a low angle, predominantly horizontally polarized mode, i.e., providing one of two spatially orthogonal modes.

However, it is preferable to feed four-arm antenna structures with a hybrid network having two input ports wherein each arm is coupled to each of two independent inputs. This configuration enables simultaneous operation in a desired combination of transmit and receive modes. The capabilities to be realized from feeding a four-arm radiating structure with two independent sources include: 1) simultaneous operation at two frequencies; 2) simultaneous transmission with two polarizations and/or spatially orthogonal patterns; and 3) simultaneous transmission and reception using a combination of available polarization and spatially orthogonal patterns.

The full potential for simultaneous multi-modal operation with four-arm antennas has not been realized because simultaneous feeding of multiple antenna arms with more than one input signal requires that electrical isolation be maintained between the inputs. Nevertheless, efforts to simultaneously generate multiple radiation patterns with four-arm antennas have been at least partially successful. U.S. Pat. No. 4,635,070 to Hoover entitled "Dual Mode Antenna Having Simultaneous Operating Modes" discloses one design in which a four-arm, broad band antenna simultaneously operates in high angle and low angle modes. The Hoover patent also suggests a circuit network for feeding three sources into four output ports. This alternate configuration reportedly can provide three radiation patterns simultaneously. All of the multi-modal circuit configurations disclosed in the Hoover patent require balun transformers to transform the coaxial (unbalanced) impedance to a balanced impedance, and hybrid transformers to isolate the sources from one another.

Difficulties associated with isolating the inputs in larger feed networks have limited the number of modes in which four-arm antenna systems can simultaneously operate. Thus, there has remained a need to provide improved feed networks for four-arm antennas in order to further the multi-modal capabilities of log periodic antenna systems. More generally, it is a desire of the art to further increase the number and types of modal operations which can be simultaneously performed with broad band, multiarm antennas. It is also desirable to improve performance while reducing the size, weight and cost of hybrid networks for multiarm antenna systems.

SUMMARY OF THE INVENTION

According to one embodiment of the invention there is provided a hybrid circuit module having first and second pairs of input terminals, making a total of four input terminals, and four output terminals. First, second, third and fourth baluns each include first and second transmission line wires. The baluns are configured between the input and output terminals to isolate sources when placed across pairs of input and output terminals.

An associated method assembling a plurality of hybrid circuit modules is also disclosed. The modules each have two or more pairs of first terminals and four second terminals. According to the method, the first terminals of a first group of modules are connected to the first terminals of a second group of modules. This imparts a desired phase transformation to a signal at one or more second terminals in the second group of modules after the signal is introduced across a pair of first terminals in a first module. The desired phase transformation may be 180 degrees.

According to the invention there is provided an antenna system formed with the above-referenced hybrid circuit module and a plurality of radiators which can be configured to form a multiarm rotationally symmetric antenna. The circuit module may be configured to simultaneously generate or receive two or more independent radiation patterns. Preferably, the radiators are arranged to define a log-periodic antenna for broad band operation.

In another embodiment of the invention, a multi-port network of the type used to feed a multiarm antenna comprises four pairs of first terminals which are rf isolated from one another, and four second terminals which are rf isolated from one another. In an exemplary application of the multi-port network each pair of first terminals is connected to either a source or a receiver, and each second terminal is connected to an identical load. Preferably the network is formed with four of the above-described hybrid circuit modules.

A method is provided for feeding a multiarm antenna structure with a hybrid circuit network wherein the antenna structure includes a plurality of radiating arms. According to the method a first terminal of each arm is connected to the network, and all of the second terminals are coupled to one another. In one embodiment of the method, with the antenna structure having four arms that are coupled to one another, the method includes the steps of symmetrically positioning a conductive element with respect to all of the arms and coupling the second terminals to the network through the conductive element. Alternately, the second terminals may be electromagnetically coupled to the network without requiring the conductive element. The method also includes the step of simultaneously feeding the antenna arms with four independent signals in order to patterns four different radiation patterns.

It is an object of the invention to improve the capabilities of multiarm antennas for simultaneous operation in a plurality of modes.

It is a further object of the invention to provide an antenna feed network which increases the number of modes in which an antenna system can simultaneously transmit and receive signals.

It is another object of the invention to provide a hybrid feed network capable of providing four input sources to a multiarm log spiral antenna.

The features and advantages of the invention will be best understood from the following detailed description when read in conjunction with the accompanying drawings.

DESCRIPTION OF THE FIGURES OF THE DRAWING

FIG. 10 presents an antenna system formed with the circuit structure of FIG. 5;

FIGS. 11A, 11B, 11C and 11D illustrate, respectively, the phase relationships between antenna arms in the system of FIG. 10 when a source is introduced at each of the different inputs $I_1$, $I_2$, $I_3$ and $I_4$;

DETAILED DESCRIPTION OF THE PREFERRED EMBODIMENTS

Figure 1:
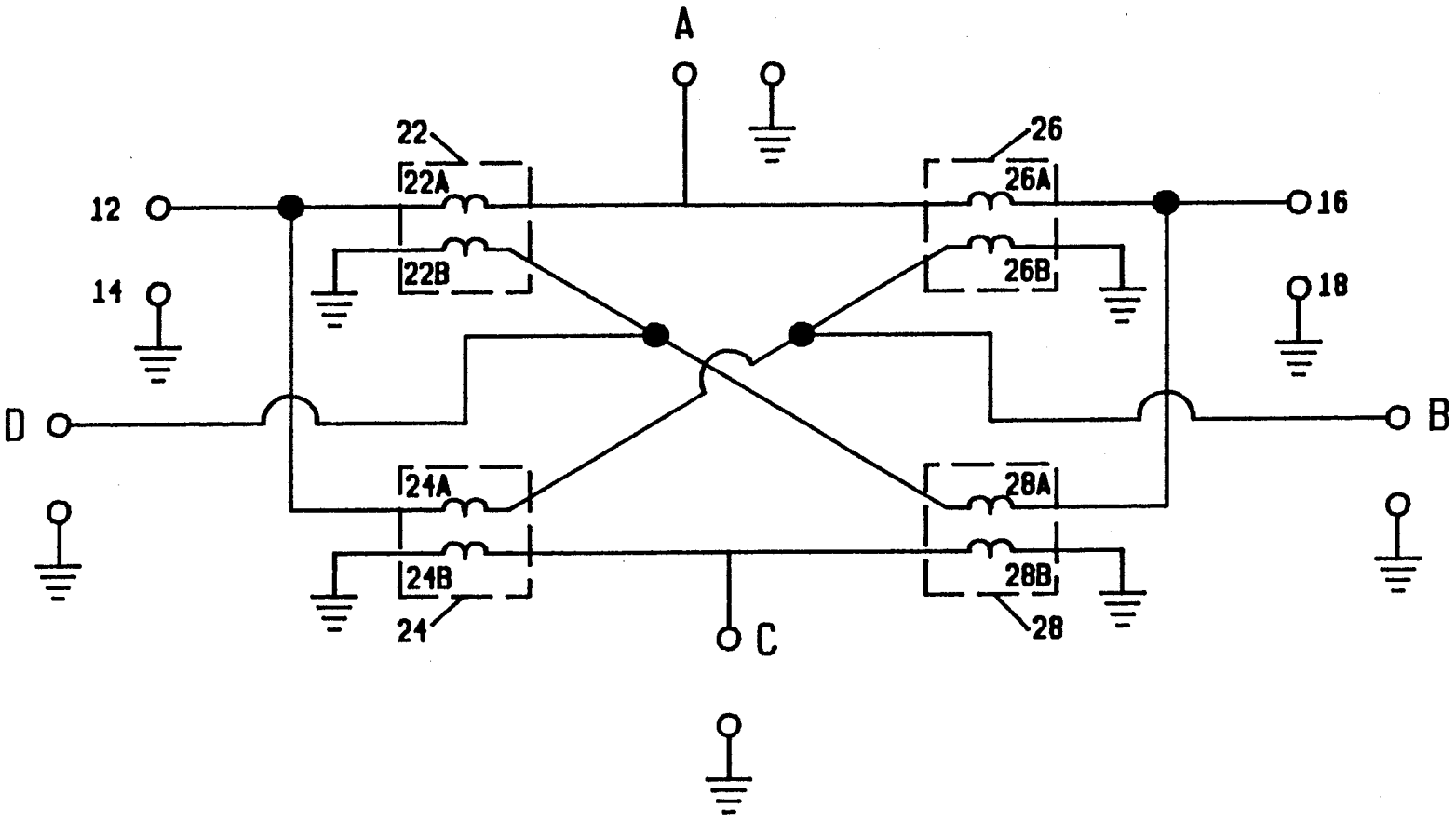
FIG. 1 illustrates a multi-port, hybrid circuit module according to the invention.

In the several figures, like components are designated with similar reference characters in order that continuity of the inventive concept will be more readily apparent in the several embodiments of the invention. The specific circuit arrangements, electrical components and materials used to describe the invention are merely exemplary.

Although certain preferred embodiments of the invention are now described, it should be appreciated that in a general form the present invention provides a multiport network comprising multiple input terminals and multiple output terminals. While they are described in the context of radio frequency (rf) transmission and reception, the networks disclosed herein, as well as the principles upon which these networks operate, are useful in any application where it is desirable to isolate two or more inputs in a network from one another. The networks are also useful when it is desirable to isolate two or more output terminals from one another in a network.

The term "isolate" and derivatives thereof, e.g., "isolation," as used herein with regard to the various circuit terminals of the invention, do not refer to direct current (DC) isolation. Rather, these terms are being used in reference to electrical isolation of rf alternating current (AC) signals which may be applied across different input or output terminals. Further, it will be appreciated that while certain junctions are being described in relation to one another as input and output terminals, these functional designations are referenced as such only for purposes of exemplary illustration. In certain configurations these junctions may be interchanged to suit a desired application of the invention.

A variety of electrical circuits make use of baluns and transformers to convert unbalanced impedances to balanced impedances and vice versa and to transform impedance levels. At low frequencies, e.g., below 500 kHz, this is achieved with iron-core transformers and an assortment of windings such as a primary winding and a secondary winding. The invention could be assembled and operated with such baluns and transformers. However, at rf frequencies, iron-core devices exhibit significant losses and leakage reactances—even when the most efficient iron cores are used.

Great improvement in balun and transformer performance is had at radio frequencies, e.g., 2 to 30 MHz, when ferrite cores are used in lieu of iron cores. Moreover, transformers having independent windings, i.e., primary and secondary windings, can be replaced with auto-transformers, transmission line transformers and baluns to further improve efficiency. Preferred embodiments of the invention for rf applications will utilize transmission line baluns. Such baluns are formed with a two-wire transmission line wound on a ferrite core. The wires are covered with Teflon insulation and are often immersed in transformer oil (such as Diala AX available from the Shell Oil Co.) to conduct heat away from the wires. This oil has approximately the same dielectric constant as the Teflon insulation, so that abrupt discontinuities between the wires and their connections are eliminated.

A feature of the transmission line balun wrapped on a ferrite core is that a balanced transmission line has equal current magnitudes and opposite phases in the two conductors. The equal amplitudes and opposite phases tend to cancel magnetic flux in the ferrite core. However, there must be sufficient coil inductance to assure that when a terminal is grounded the currents in the pair of wires remain substantially balanced, i.e., nearly equal in amplitude and opposite in phase. This condition can be achieved when the inductive reactance of the coil is about five times the characteristic impedance of the two-wire line. Of course, the actual design is dependent upon the relative permeability of the ferrite, the number of turns and the size of the core. Further, it is often desirable to limit the flux density of the ferrite to 100 gauss in order to prevent harmonic generation in excess of −60 dB and to prevent over-heating. Other useful information relating to the properties of ferrites is presented by E. C. Smelling and A. D. Giles in *Ferrites for Inductors and Transformers*, John Wiley & Sons, Inc., New York (1983).

In view of the above remarks, it should now be appreciated that baluns have been known for some time; but this specification teaches a new way of utilizing baluns to create a hybrid feed system or network that provides a surprising improvement in performance over known networks. And this new way of using baluns finds particular utility in the antenna field where certain parameters have caused difficulties in the prior art.

Referring first to FIG. 1 there is illustrated a two-source, four-output hybrid circuit module 10 having two pairs of input terminals, i.e., a first pair of first and second terminals 12 and 14, and a second pair of first and second terminals 16 and 18. The second terminals 14 and 18 are coupled with other circuit nodes, as indicated in the figures, to a reference potential which may be regarded as a common ground. When an alternating current source, e.g., typically an rf generator, is coupled across each pair of input terminals, the signal provided to one terminal in a pair is, at any point in time, 180 degrees out of phase with the signal provided to the other terminal in the same pair.

Each module 10 includes first, second, third and fourth transmission line baluns 22, 24, 26 and 28 arranged to isolate one pair of input terminals 12, 14 from the other pair of input terminals 16, 18. In a preferred embodiment each balun comprises first and second equally spaced transmission line wires. The wires are insulated from one another and wrapped about a toroidal shaped ferrite core. Such baluns are commonly used in transformer circuits to perform impedance matching function. The baluns of the module 10 are not transformers in the conventional sense, i.e., the voltage conversion sense; rather, the first and second transmission line wires of each balun are preferably of substantially the same length. Throughout the figures the first transmission wire of each balun is designated by the balun reference numeral followed by the letter "A", and the second transmission wire of each balun is designated by the balun reference numeral followed by the letter "B". Thus, for example, the wires of the balun 22 are designated 22A and 22B.

During module operation, the currents in each pair of balun wires are equal in magnitude and opposite in phase. Therefore, the net magnetic flux through the associated ferrite core is zero. If the magnitude of current flow through the paired transmission wires A and B were to become unequal, the imbalance would create a net magnetic flux in the ferrite core. Consider, for example, the possibility of paired wires A and B wherein the current magnitude in wire A becomes slightly larger than the current magnitude in wire B. If this were to occur, the net flux would pass through the high permeability ferrite core and, in turn, generate a large inductance in the transmission line carrying the higher magnitude current. This inductance would provide a high reactance to restrain the current in wire A from increasing.

The preferred arrangement of circuit components in the module 10 will now be described. The first transmission wire 22A of the first balun 22 is connected between the first input terminal 12 and the output terminal A. The first transmission wire 24A of the second balun 24 is connected between the first input terminal 12 and the output terminal B. The first transmission wire 26A of the third balun 26 is connected between the first input terminal 16 and the output terminal A. The first transmission wire 28A of the fourth balun 28 is connected between the output terminal D and the first input terminal 16.

The second transmission wire 22B of the first balun 22 is connected between the output terminal D and the second input terminal 14. The second transmission wire 24B of the second balun 24 is connected between the output terminal C and the second input terminal 14. The second transmission wire 26B of the balun 26 is connected between the output terminal B and the second input terminal 18. The second transmission wire 28B of the balun 28 is connected between the output terminal C and the second input terminal 18.

Operation of the module 10 in a complete circuit, including a circuit network formed with multiple modules as discussed below, is based on isolation between the pairs of input terminals. As already noted, each pair of input terminals (12, 14) and (16, 18) is DC coupled to each of four output terminals A, B, C, and D. Nevertheless, an AC signal provided to either of the two pairs of input terminals will remain isolated from an AC signal provided to the other pair of terminals. More specifically, with an identical load placed across each output terminal with respect to ground, it is possible to provide isolation between a first AC signal applied to the first pair of input terminals 12, 14 and a second AC signal applied to the second pair of input terminals 16, 18.

Figure 2A:
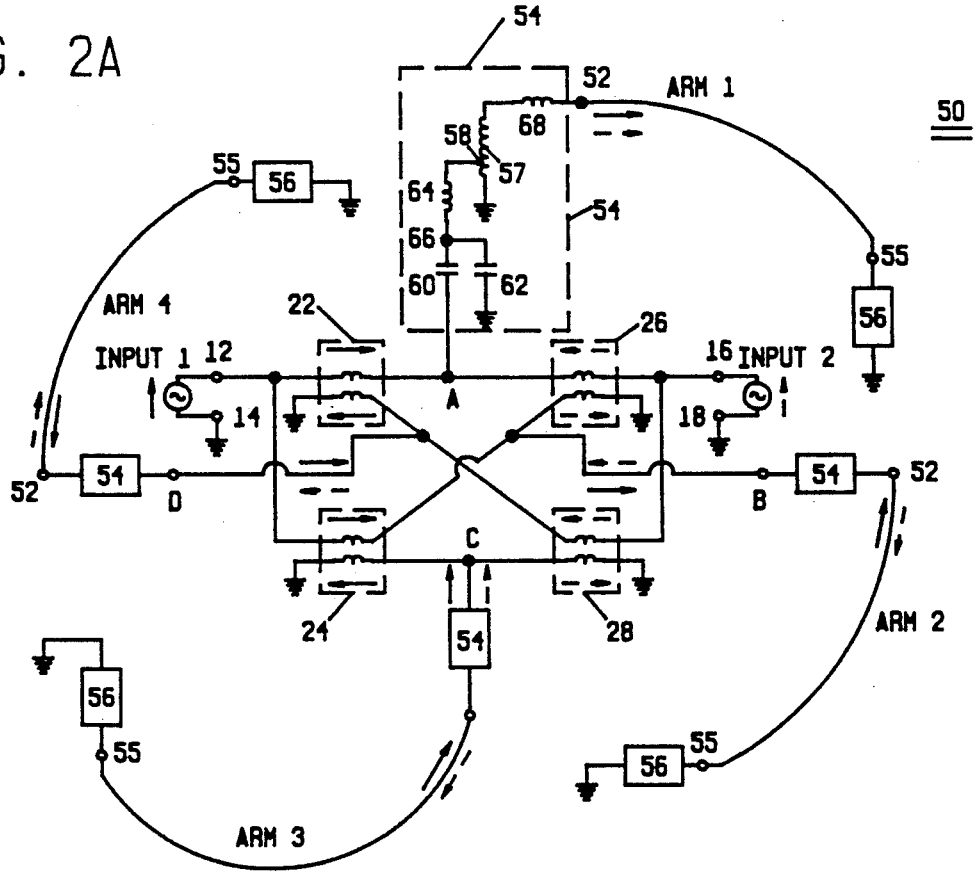
FIGS. 2A and 2B schematically illustrate two coupling schemes for an exemplary four-arm, log spiral antenna system fed by the module of FIG. 1.

In order to more fully present the manner in which the module 10 operates, FIG. 2A (not drawn to scale) schematically illustrates an antenna system 50 comprising the module 10 coupled to feed an exemplary four-arm, log spiral antenna. A first terminal 52 on each of the four arms, designated ARM 1, ARM 2, ARM 3 and ARM 4, is coupled through an impedance-matching network 54 to one of the output terminals A, B, C or D. A second terminal 55 on each arm is tied through a resistive termination 56 to ground. The resistive termination extends the frequency range of the antenna system. Each network 54 is formed with an auto-transformer 57 having a center tap node 58.

Compensation circuitry, which is required to compensate for the leakage reactance of the auto-transformer 57, includes a first capacitor 60, a second capacitor 62 and a coil 64. Both capacitors 60 and 62 and the coil 64 have a terminal tied to a node 66. The first capacitor 60 couples the node 66 to an output terminal and a second capacitor 62 couples the node 66 to ground. The coil 64 couples the node 66 to the center tap node 58. One end of the auto-transformer 57 is tied to ground and the other end is coupled through an inductor 68 to a first terminal 52 of an antenna arm. The inductor 68 provides compensation for the shunt capacitance that is introduced when a ceramic bushing (not shown) is used as an insulative feed through to the output terminal.

In preferred circuit designs the baluns 22, 24, 26 and 28 have a characteristic impedance of 100 Ohms, and the hybrid circuit module 10 has a 50 Ohm impedance at the input and output terminals. In the case of a four-arm conical log-spiral antenna, it can be assumed for purposes of illustration that the antenna impedance of each arm is 400 Ohms. The auto-transformer 57 transforms the 50 Ohm impedance of the module 10 output terminal A, B, C or D to match the 400 Ohm impedance of an antenna arm. The impedance-matching networks minimize the voltage standing wave ratio (VSWR), e.g., to less than 1.1:1, over the frequency range extending from about 2 to 30 MHz. When the networks 54 are formed with a 4000 picofarad capacitor 60, a 100 picofarad capacitor 62 and a 0.5 microhenry coil 64, an insertion VSWR of 1.2:1 can be obtained.

In the arrangement of FIG. 2A the coupling scheme between the four arms and the four outputs is clockwise sequential. Thus, when an rf signal is applied across either of the pairs of input terminals, signals radiated by pairs of adjacent arms will be additive in the zenith direction. That is, when INPUT 1 is applied across the terminals 12, 14, the signals radiated by all four arms are additive in the zenith direction. ARM 1 and ARM 2 are in-phase and ARM 3 and ARM 4 are both 180 degrees out of phase with ARM 1 and ARM 2. This pattern is illustrated in FIG. 2A with solid arrows.

Similarly, when INPUT 2 is applied across the terminals 16, 18, signals radiated by all four arms are additive in the zenith direction. This pattern is illustrated by dashed arrows in FIG. 2A. ARM 1 and ARM 4 are in-phase with one another while both ARM 2 and ARM 3 are 180 degrees out of phase with ARM 1 and ARM 4. Except for a 90 degree spatial rotation of the electromagnetic vectors, the radiation pattern produced by INPUT 2 is identical to that produced by INPUT 1. That is, INPUT 1 produces the same field pattern on ARM 1 and ARM 2 that INPUT 2 produces on ARM 1 and ARM 4—except that the patterns are orthogonal to one another in space.

With clockwise sequential coupling between the output terminals A, B, C and D and the antenna arms, as illustrated in FIG. 2A, INPUT 1 and INPUT 2 individually result in a high angle radiation pattern such as illustrated in FIG. 3. When incorporated into the system 50, the module 10 can provide two simultaneous independent radiation patterns; or, the antenna system can radiate a first pattern in response to a first signal provided across one pair of input terminals, while simultaneously receiving a second pattern whose signal becomes available at the other pair of input terminals. Alternately, the system 50 can be used entirely in a receive mode to independently provide different signals picked up by the antenna to each pair of terminals 12, 14 and 16, 18. The coupling scheme is not limited to four-arm spiral antennas, but may be used with other spatially orthogonal radiators such as the linear radiators used by Antenna Products Corp. with their HT-20T and HT-22 antennas.

Figure 2B:
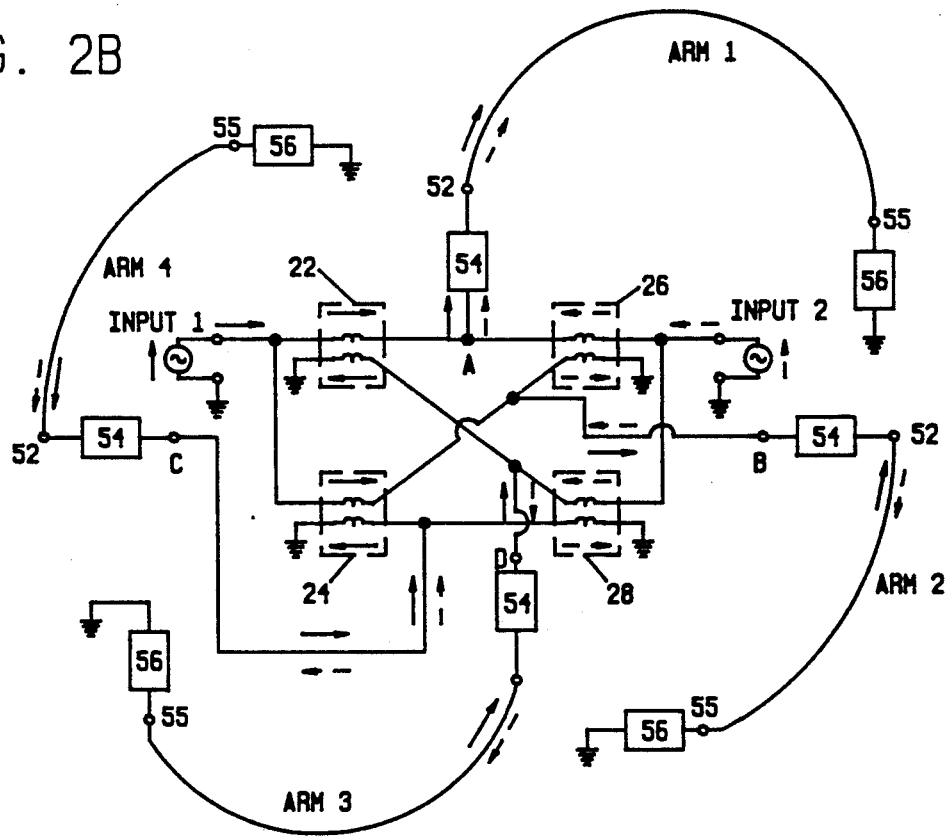
Figure 3A:
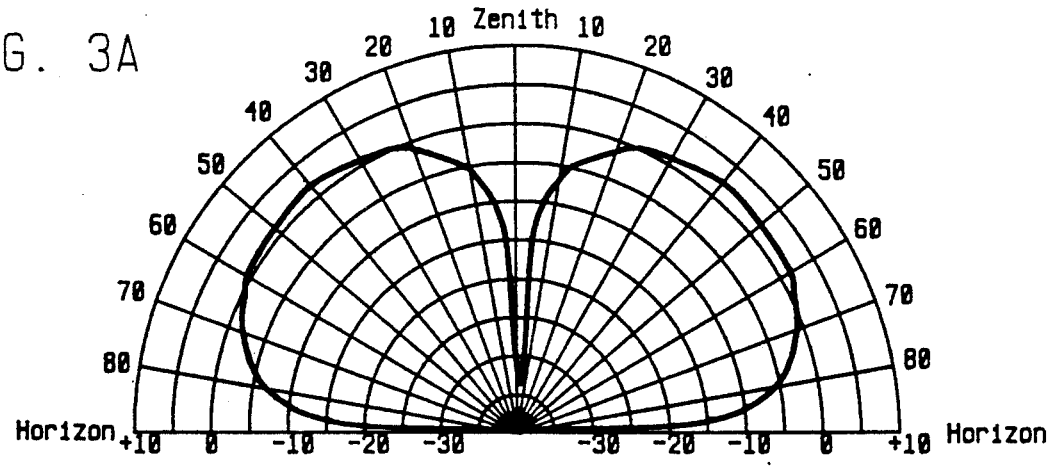
FIGS. 3A and 3B qualitatively illustrate low angle radiation patterns (elevation and azimuth)
Figure 3B:
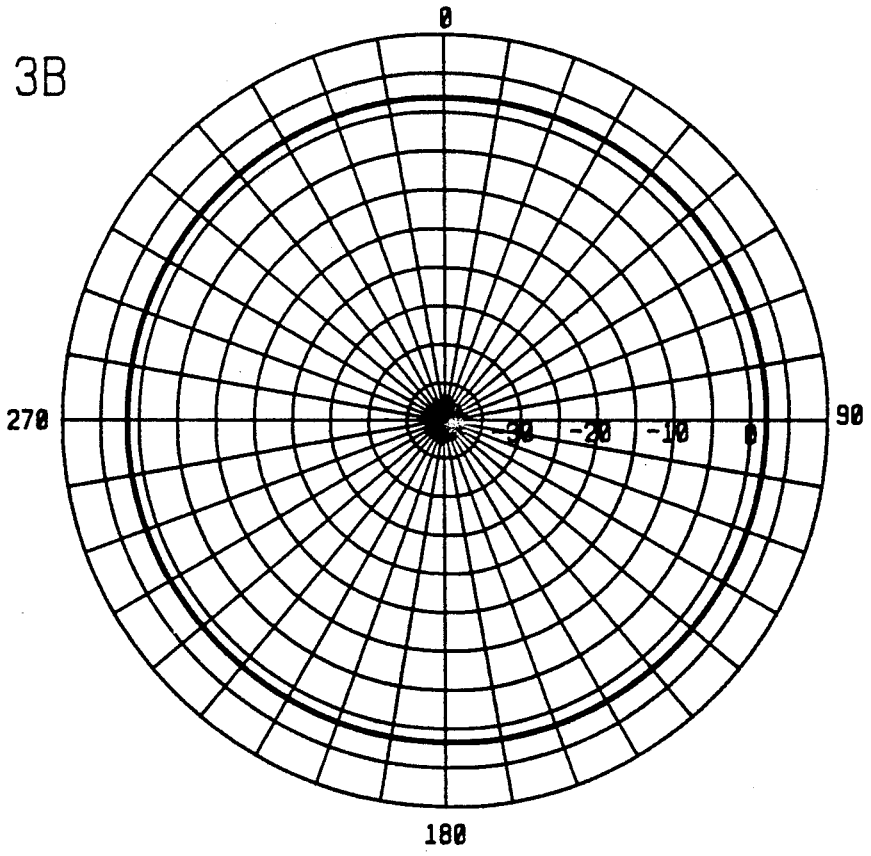
Figure 3C:
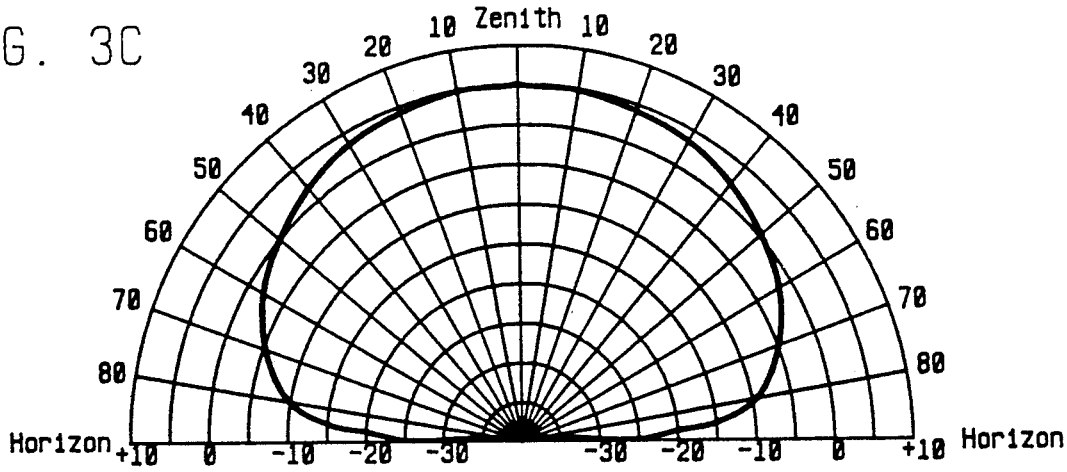
FIGS. 3C and 3D illustrate high angle radiation patterns (elevation and azimuth) obtainable with an antenna system constructed according to FIGS. 2A and 2B.
Figure 3D:
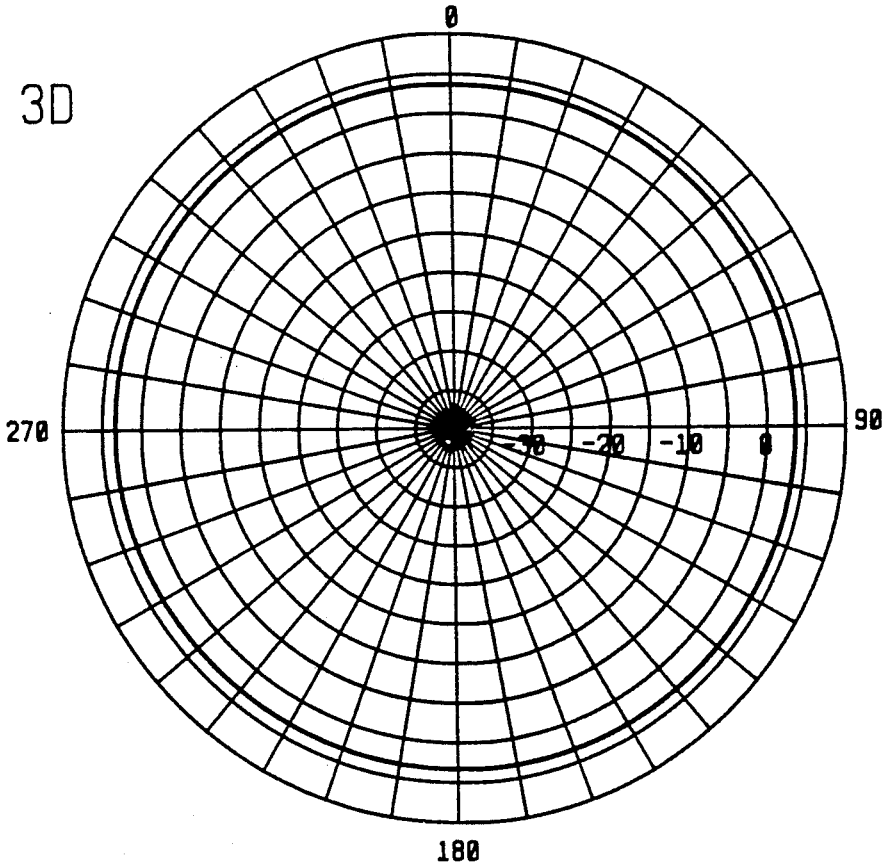

The coupling scheme may be changed from the sequential arrangement of FIG. 2A to provide other relationships (e.g., 180 degree phase differences) between the various antenna arms, thereby providing other patterns. For example, FIG. 2B schematically illustrates a modified coupling arrangement for the same antenna system 50 wherein the INPUT 1 generates currents (indicated with dashed arrows) in ARM 1 and ARM 3 which are 180 degrees out of phase with the currents generated in ARM 2 and ARM 4. This is effected by connecting ARM 1 to the output terminal A and connecting ARM 2 to the output terminal B as in FIG. 2A, but interchanging the remaining two connections so that ARM 3 is coupled to the output terminal D and ARM 4 is coupled to the output terminal C. With this configuration INPUT 2 provides a low angle, normal mode radiation pattern such as illustrated in FIG. 3A (elevation pattern) and FIG. 3B (azimuth pattern), while currents generated by INPUT 1 (indicated with solid arrows) provide a high angle, axial mode pattern such as illustrated in FIG. 3C (elevation pattern) and FIG. 3D (azimuth pattern).

In either configuration—FIG. 2A or FIG. 2B—when the antenna arms provide the same load, e.g., 400 Ohms, the inputs across terminals 12, 14 and terminals 16, 18 are isolated from one another. With this isolation INPUT 1 and INPUT 2 may differ in magnitude and frequency.

The principles of source isolation exhibited when identical loads are provided to the output terminals A, B, C and D of the module 10, stem from the current control properties of the baluns 22, 24, 26 and 28 in the above-described coupling configuration. The pair of first and second transmission wires A and B associated with a particular balun carry equal currents in opposite directions to preserve balanced conditions. Current flow through the baluns of the module 10 is also illustrated in FIG. 2A by the solid arrows representing the direction of current flow provided by INPUT 1, and the dashed arrows representing the direction of current flow provided by the INPUT 2.

Figure 4:
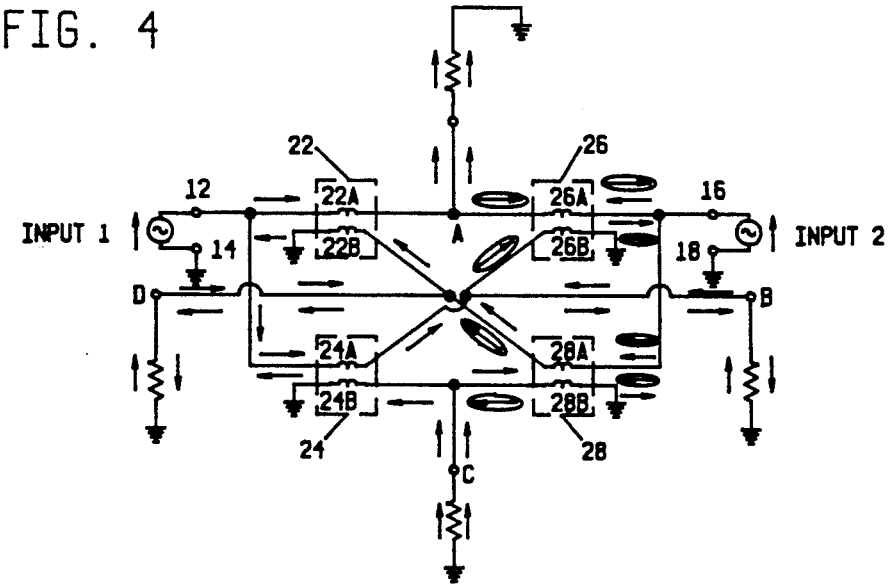
FIG. 4 illustrates principles underlying current source isolation exhibited by the module of FIG. 1.

The role of the baluns in current source isolation will be more readily apparent from the illustration of FIG. 4, wherein INPUT 1 generates currents through the baluns 22 and 24 (as indicated by solid arrows) and INPUT 2 generates currents through the baluns 26 and 28 (as indicated by dashed arrows). These inputs will produce currents in all of the loads Z as previously illustrated for the antenna system 50. The loads Z are assumed to be substantially identical.

With the balanced load of FIG. 4, a person might consider how INPUT 1 could possibly couple with INPUT 2. In order for this to occur, the INPUT 1 current flowing through wire 22A of the balun 22 would pass through wire 26A of the balun 26, as suggested by a circled solid arrow. Similarly, the INPUT 1 current flowing through wire 24A of the balun 24 would pass through wire 26B, as also suggested by a circled arrow. Since these current flows, i.e., the flows indicated by circled solid arrows, would be in the same direction, their magnitudes would be additive, thereby generating a large magnetic flux in the ferrite core of the balun 26; and, consequently, a large reactance in series with each current designated by a circled arrow. The large reactance would, in turn, restrain the current flow, which is suggested by the circled arrows, to isolate INPUT 1 from INPUT 2.

Similarly, if the INPUT 1 current flowing through the wire 22B were to flow through the wire 28A of the balun 28, and if the INPUT 1 current flowing through the wire 24B of the balun 24 were to flow through wire 28B of the balun 28, as again suggested by the circled solid arrows, such currents would be additive. The additive currents would generate a large magnetic flux which would, in turn, create a reactance in opposition to the current flow indicated by the circled arrows. Similar effects relating to INPUT 1, as have been described for the balun 26, will also occur in the balun 28. Due to this high reactance characteristic exhibited by each of the baluns 22, 24, 26 and 28 for additive currents, when an rf signal is provided across either of the two pairs of input terminals the resulting current flow will not interfere with an input signal provided across the other pair of terminals. That is, substantial source isolation can be achieved. Typically, isolation to a level of approximately 30 dB is readily attainable and this is generally acceptable in rf circuitry.

Figure 5:
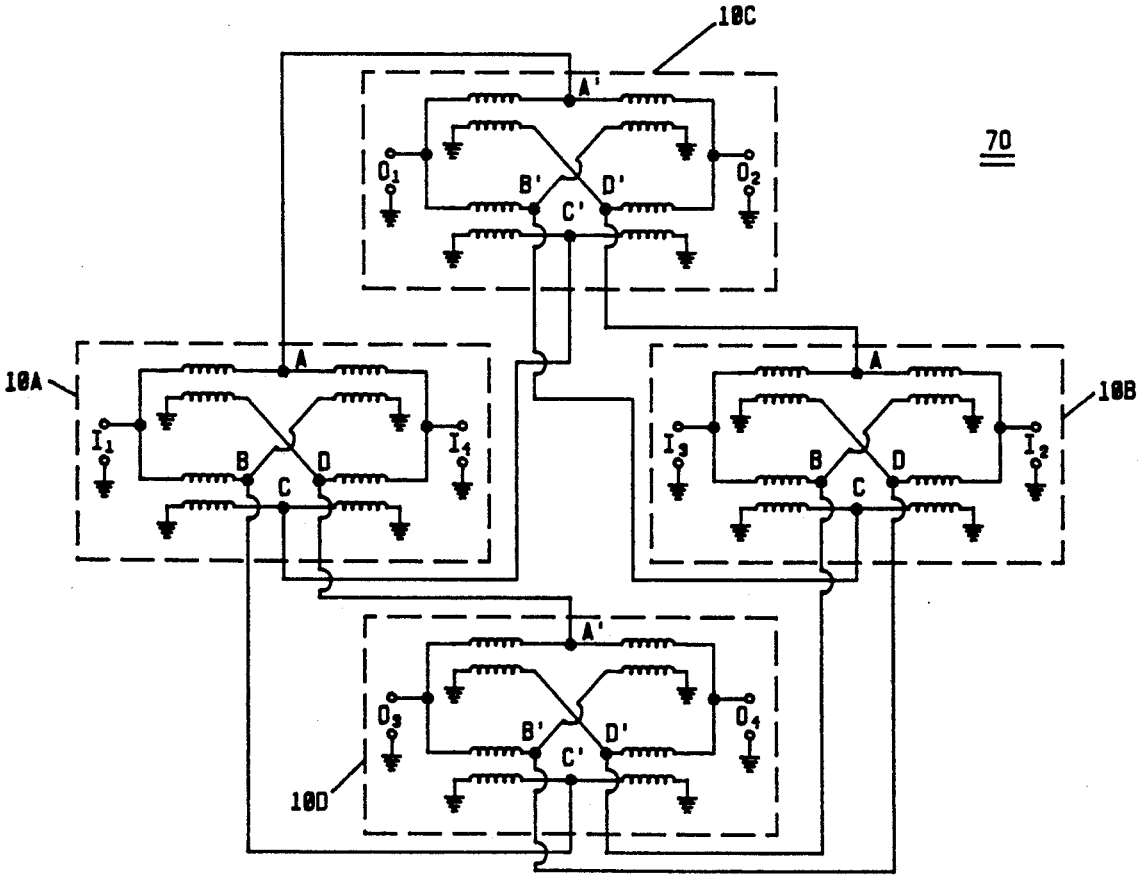
FIG. 5 illustrates a hybrid circuit structure having four isolated inputs and four isolated outputs.
Figure 6:
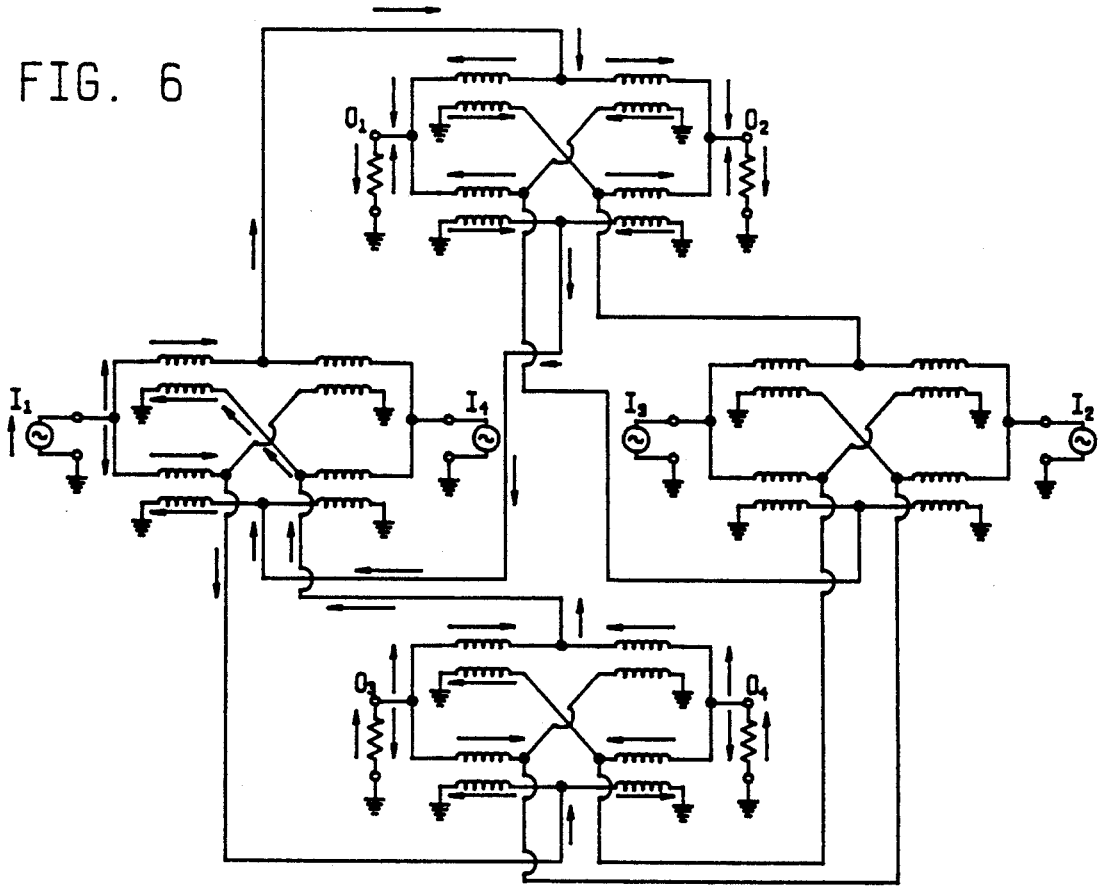
FIGS. 6, 7, 8 and 9 illustrate the various currents which flow through the circuit structure of FIG. 5 when a source is introduced at each of the inputs.
Figure 7:
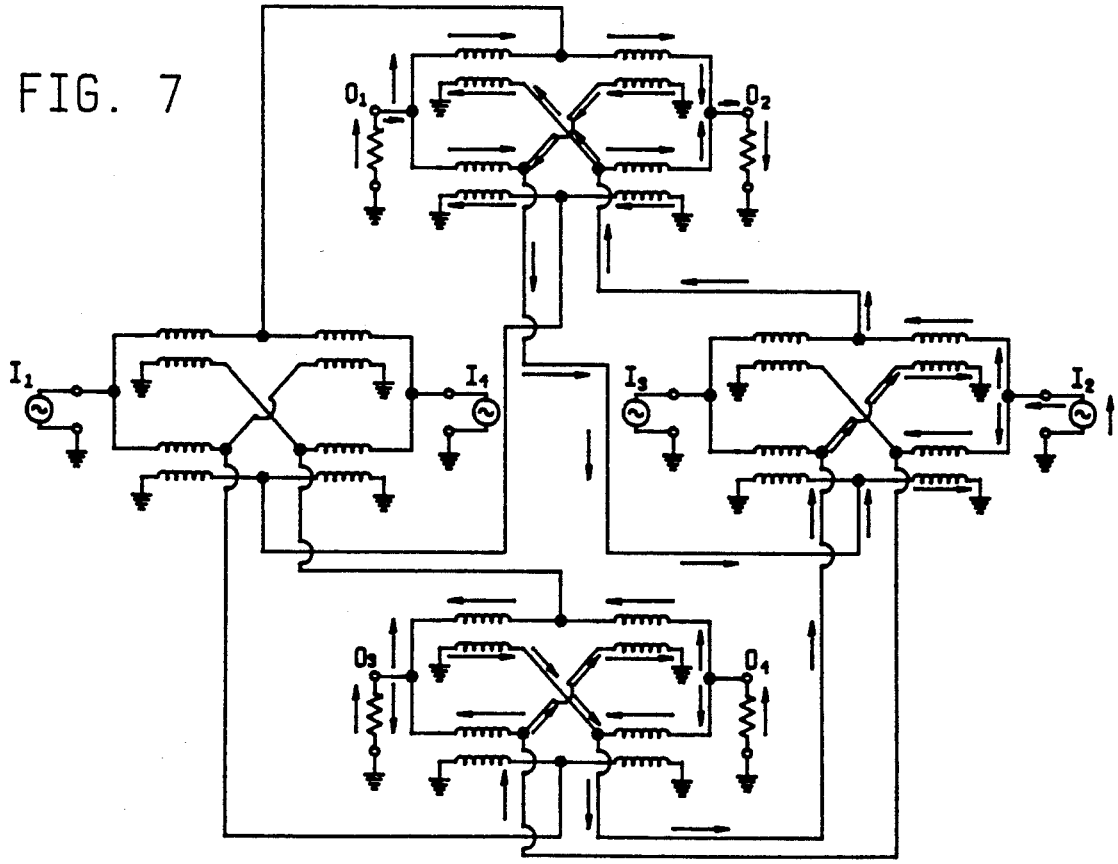
Figure 8:
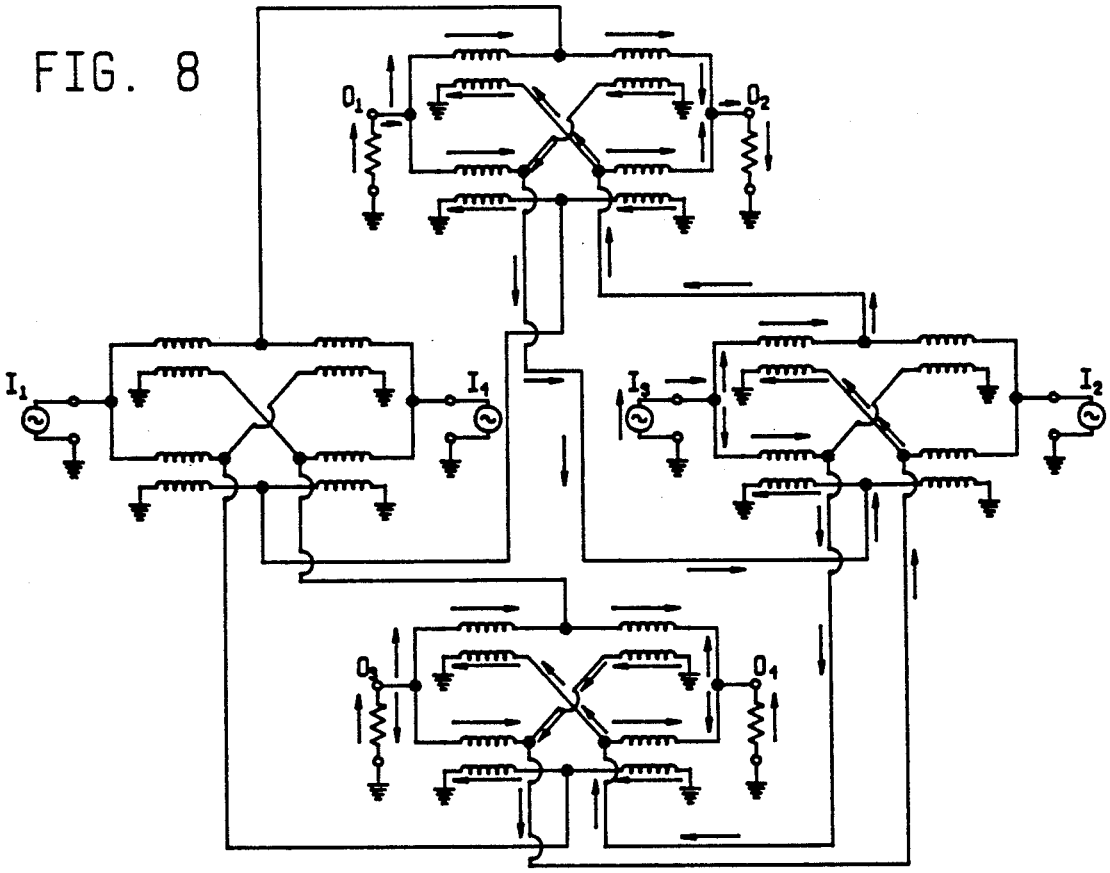
Figure 9:
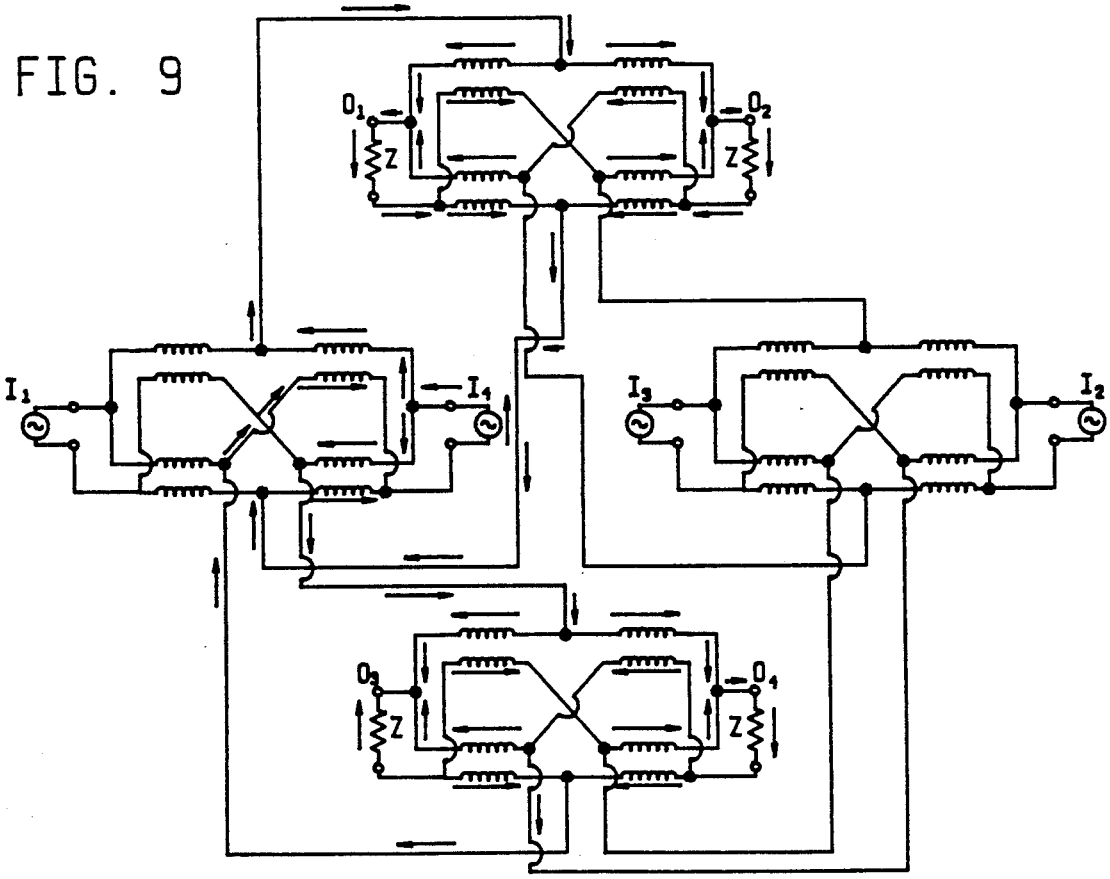

A feature of the present invention is the formation of a multi-port network comprising more than two pairs of isolated input terminals. FIG. 5 illustrates such a hybrid circuit structure 70 having four inputs $I_1$, $I_2$, $I_3$ and $I_4$ and four output terminals $O_1$, $O_2$, $O_3$, and $O_4$. The circuit structure 70 comprises four of the circuit modules 10, designated in this figure as 10A, 10B, 10C and 10D. The inputs $I_1$ and $I_4$ of the module 10A and the inputs $I_2$ and $I_3$ of the module 10B correspond to the module 10 input terminals 12, 14, 16 and 18 (FIG. 1). Also, as illustrated for the module 10, the modules 10A and 10B each include four output terminals A, B, C and D. Each of these eight output terminals are connected to one of four input terminals A', B', C' and D' on either of the modules 10C and 10D. The module 10C includes two output ports $O_1$ and $O_2$, and the module 10D includes two output ports $O_3$ and $O_4$.

A comparison between the circuit module 10 of FIG. 1 and each of the modules 10C and 10D make clear that the input terminals A', B', C' and D' correspond to the four output terminals A, B, C and D of the modules 10, 10A and 10B. Furthermore, the output ports $O_1$, $O_2$, $O_3$ and $O_4$ correspond to the pairs of input terminals 12, 14 and 16, 18 of the module 10.

With equal loads Z connected to all of the output ports $O_1$, $O_2$, $O_3$, and $O_4$ in the circuit structure 70, a signal applied to any of the inputs $I_1$, $I_2$, $I_3$ and $I_4$ will remain isolated, e.g., to 30 dB, from any of the other three inputs. Furthermore, the four output terminals $O_1$, $O_2$, $O_3$, and $O_4$ will remain electrically isolated from one another.

FIGS. 6, 7, 8 and 9 illustrate the respective current flows to all of the output ports $O_1$, $O_2$, $O_3$ and $O_4$ when a source is introduced at each of the inputs $I_1$, $I_2$, $I_3$ and $I_4$. As illustrated with the circuit schematic of FIG. 9, the loads Z can be tied in common to provide a return current path to the circuit structure 70 when a signal is applied to the input $I_4$. This same configuration, while not necessary, is desirable when applying signals to the inputs $I_1$, $I_2$ and $I_3$ so that signals can be generated by all of the inputs with the same circuit configuration. Preferably, when applying a signal to any of the inputs $I_1$, $I_2$, $I_3$ and $I_4$, the loads Z are matched to the output impedance at each port in order to minimize the VSWR.

Another feature of this embodiment is that with identical loads Z connected to all of the output ports, the four output ports $O_1$, $O_2$, $O_3$, and $O_4$ also become electrically isolated, e.g., to 30 dB, from one another. This symmetry enables the interchange of outputs and inputs to provide a greater variety of modes which can be simultaneously generated.

In the simplified schematic block diagram of FIG. 10, an antenna system 100 comprising the four-input hybrid circuit structure 70 is configured in a manner similar to the system 50 of FIG. 2A. The arms, again designated ARM 1, ARM 2, ARM 3 and ARM 4, of an exemplary four-arm log spiral antenna are sequentially paired, through impedance-matching networks 54, with respective output ports $O_1$, $O_2$, $O_3$, and $O_4$ in a clockwise fashion. The antenna arms are tied in common to provide a return current path to the circuit structure 70. FIGS. 11A, 11B, 11C and 11D illustrate, respectively, the phase relationships between antenna arms fed in the configuration of FIG. 10, when a source is introduced at each of the different inputs $I_1$, $I_2$, $I_3$and $I_4$.

The feed pattern resulting from a source introduced either at the input $I_1$ (FIG. 11A) or the input $I_2$ (FIG. 11B) exhibits the same phase relationships between antenna arms as the configuration illustrated in FIG. 2A for the system 50 in a sequential coupling configuration. That is, the inputs $I_1$ and $I_2$ both provide patterns that are additive at the zenith. These two patterns are of substantially the same shape and gain, but have electromagnetic vectors which are spatially orthogonal. Hence, the patterns are isolated from one another in space.

The feed pattern resulting from the introduction of a source at the input $I_3$ (FIG. 11C) exhibits the same phase relationships between antenna arms as the modified coupling arrangement of the system 50 illustrated in FIG. 2B. That is, although the coupling scheme between antenna arms and output ports is clockwise sequential, when a source is introduced at the input $I_3$, the signals carried in ARM 1 and ARM 3 are additive; the signals carried in ARM 2 and ARM 4 are additive; and both ARM 1 and ARM 3 will carry signals which are opposite in phase with respect to the signals carried in both ARM 2 and ARM 4. This results in the omnidirectional low angle beam pattern illustrated in FIG. 3.

The phase relationship illustrated in FIG. 11D can result when a source is introduced at the input I4 of the circuit structure 70, indicating that all four arms can be fed in phase with one another when the loads Z are tied in common (FIG. 9) to provide a return current path—in addition to the three aforementioned patterns which can be radiated from the system 100 of FIG. 10. That is, another feature of the invention is the simultaneous provision of as many as four independent and orthogonal radiation patterns with the circuit structure 70. As illustrated schematically in the block diagram of FIG. 12, a quad-mode antenna system 120 is formed with the four-input hybrid circuit structure 70 configured in a manner similar to the system 100 of FIG. 10—wherein the four arms of a log spiral antenna are, for illustrative purposes only, sequentially paired through impedance matching networks 54, with respective output ports $O_1$, $O_2$, $O_3$, and $O_4$ in a clockwise fashion. However, to obtain a radiation pattern with the $I_4$ input, the second terminals 121, 122, 123 and 124 associated with ARM 1, ARM 2, ARM 3 and ARM 4, respectively, are coupled in common to a fifth radiator 130 which, for omnidirectionality, should be symmetrically centered with respect to the four arms. See, for example, FIGS. 14A through 14E which illustrate that if ARM 1, ARM 2, ARM 3, and ARM 4 were configured to form a conical spiral antenna, then the four terminals 121, 122, 123 and 124 would define a base plane 152 which is normal to the symmetric axis of the conical spiral antenna.

Figure 13A:
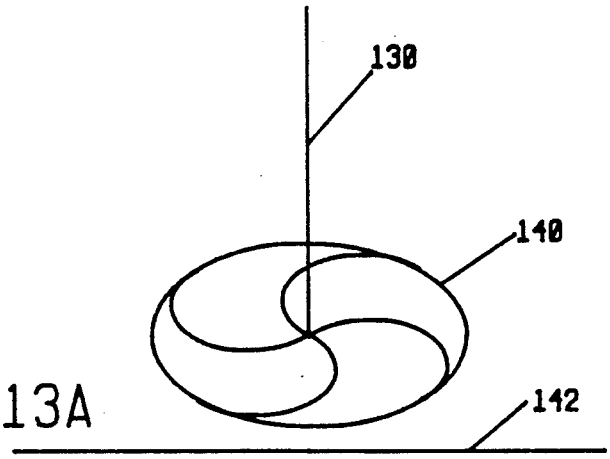
FIGS. 13A, 13B and 13C illustrate the fifth radiator in the quad-mode system of FIG. 12 positioned about a planar spiral antenna.
Figure 13B:
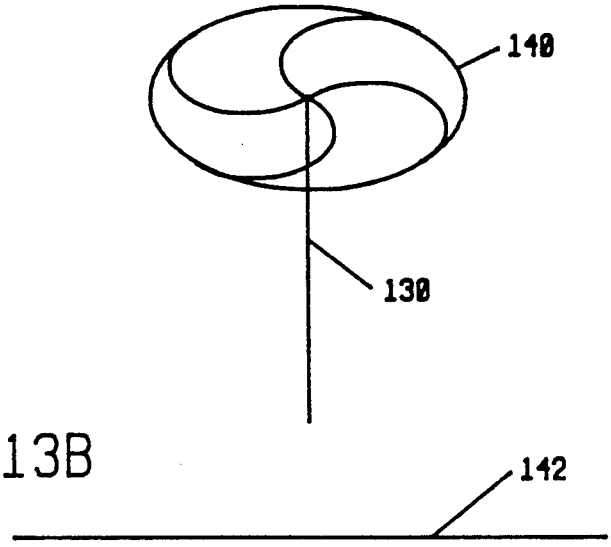
Figure 13C:
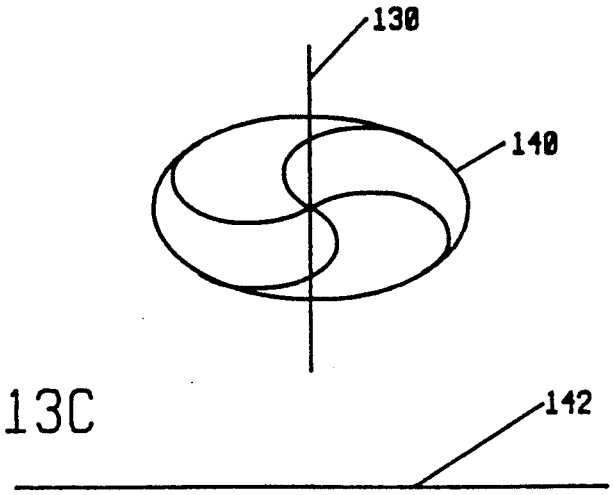

If, for example, the four arms define a planar spiral 140, the fifth radiator 130 will be positioned along a line intersecting the center of the spiral, which line is orthogonal to the plane defined by the spiral. FIGS. 13A, 13B and 13C illustrate that the fifth radiator may be positioned on either side of the planar spiral 140, with respect to a ground plane 142, or on both sides of the spiral.

Figure 14A:
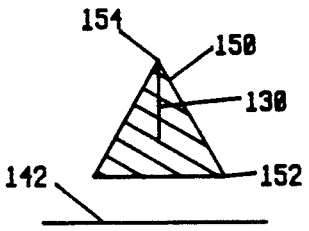
FIGS. 14A, 14B, 14C, 14D, and 14E illustrate the fifth radiator in the quad-mode system of FIG. 12 positioned about a conical spiral antenna.
Figure 14B:
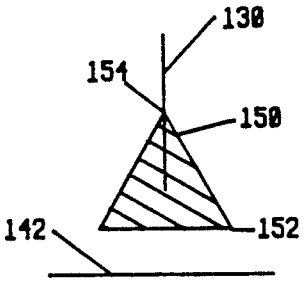
Figure 14C:
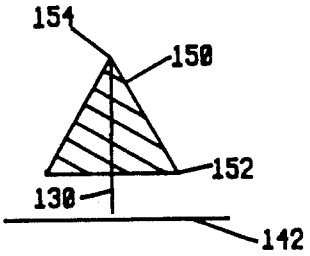
Figure 14D:
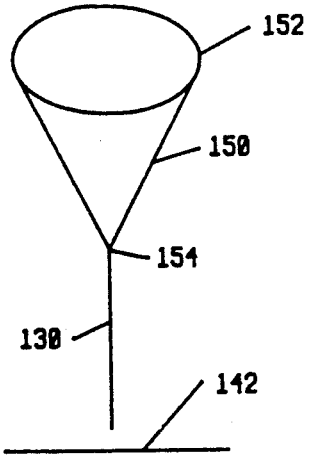
Figure 14E:
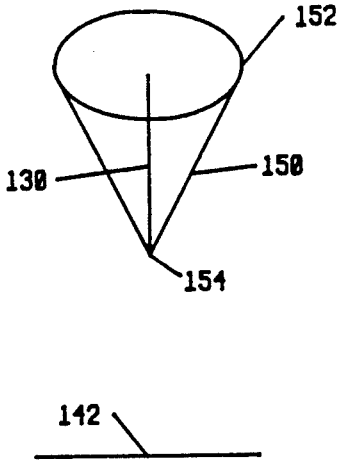

By way of further example, if the four arms define a log conical spiral 150, the fifth radiator 130 should be positioned in line with the central axis of the spiral. The radiator 130 may be positioned interiorly or exteriorly of the conical spiral 150 when the base plane 152 of the structure is positioned between the apex 154 of the conical spiral 150 and the ground plane 142, as illustrated in FIGS. 14A, 14B and 14C. Conveniently, a symmetrically positioned antenna mast may serve as the fifth radiator. Alternately, the conical spiral 150 may be inverted with respect to the ground plane, as illustrated in FIGS. 14D and 14E.

When the conical spiral antenna 150 is inverted with respect to the ground plane 142, and the apex of the cone is located coincident with the ground plane, the fifth radiator 130 becomes the ground plane, i.e., the four arms are fed in-phase (FIG. 11D) against the ground plane 142. This effect is analogous to that which is observed with a monopole structure (i.e., a whip antenna) when the source is connected between the monopole and the ground screen. RF currents are produced in the monopole with the return current being supplied from the ground screen. In the inverted embodiment of the conical spiral antenna 150, the four arms are fed in-phase and the return current is supplied from the ground plane. One distinction between this conical configuration and the example employing a monopole antenna is that the monopole is a thin, linear element which operates over a narrow frequency band, while the antenna 150 operates over a wide frequency range, thereby providing broad band performance.

Figure 12:
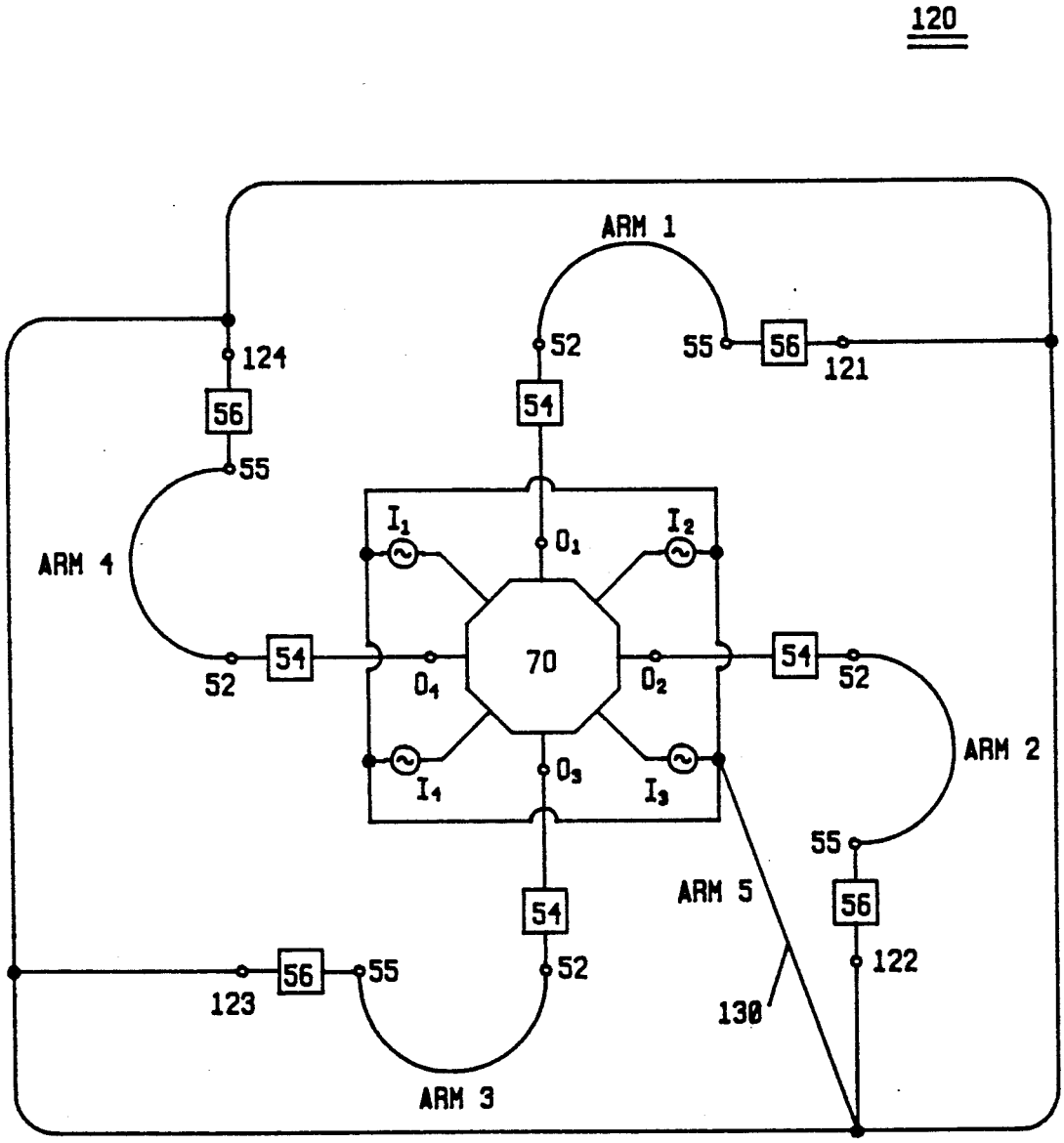
FIG. 12 is a schematic illustration of a quad-mode antenna system formed with the hybrid circuit structure of FIG. 5 and a fifth radiating arm.

Although the fifth radiator is illustrated in FIG. 12 as being wired in common with the second terminals 121, 122, 123 and 124 of the other antenna arms, this is not necessary and may be impractical in certain configurations such as shown in FIG. 14B. In lieu of a wired connection, the fifth radiator will electromagnetically couple with the second terminals to complete the circuit.

With the quad mode antenna system 120 of FIG. 12 the four input hybrid circuit structure 70 can simultaneously transmit four independent radiation patterns. Two high angle patterns and one low angle pattern such as illustrated in FIG. 3 correspond to the phase relationships shown in FIGS. 11A, 11B and 11C, and result from applying signals to the inputs $I_1$, $I_2$ and $I_3$. A fourth radiation pattern, illustrated in FIGS. 15A and 15B, and corresponding to the phase relationship shown in FIG. 11D, results from applying a signal to the input $I_4$.

The exemplary pattern of FIG. 15 is modelled for a conical spiral antenna. In an actual working embodiment of the system 120, the pitch angle is 83 degrees and the cone angle is 35 degrees. The base of the cone is located essentially at the ground level and the apex of the cone is 40 feet above the ground. The conical shape is approximated by a four sided, i.e., pyramidal, structure having a square base 60 feet in length on each side.

Figure 15A:
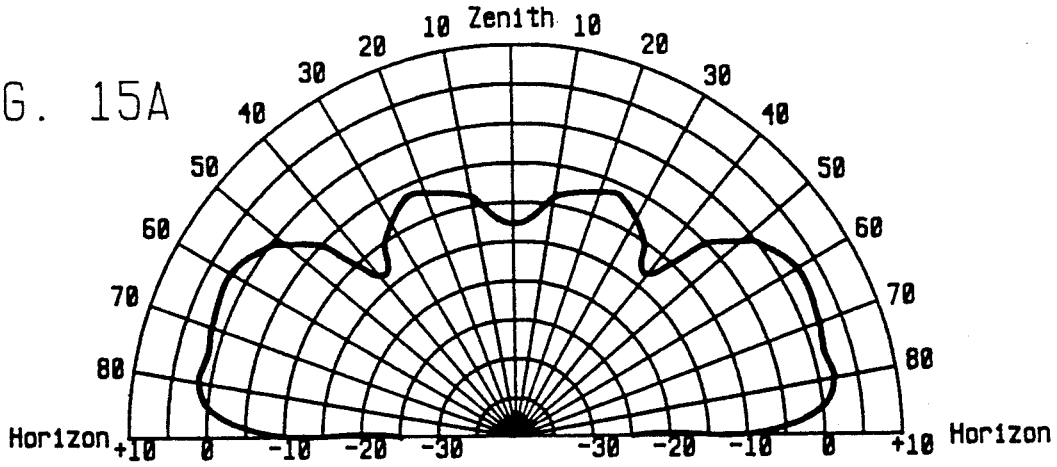
FIGS. 15A and 15B illustrate primarily vertically polarized low angle radiation patterns (elevation and azimuth) which can be generated with the system of FIG. 12.
Figure 15B:
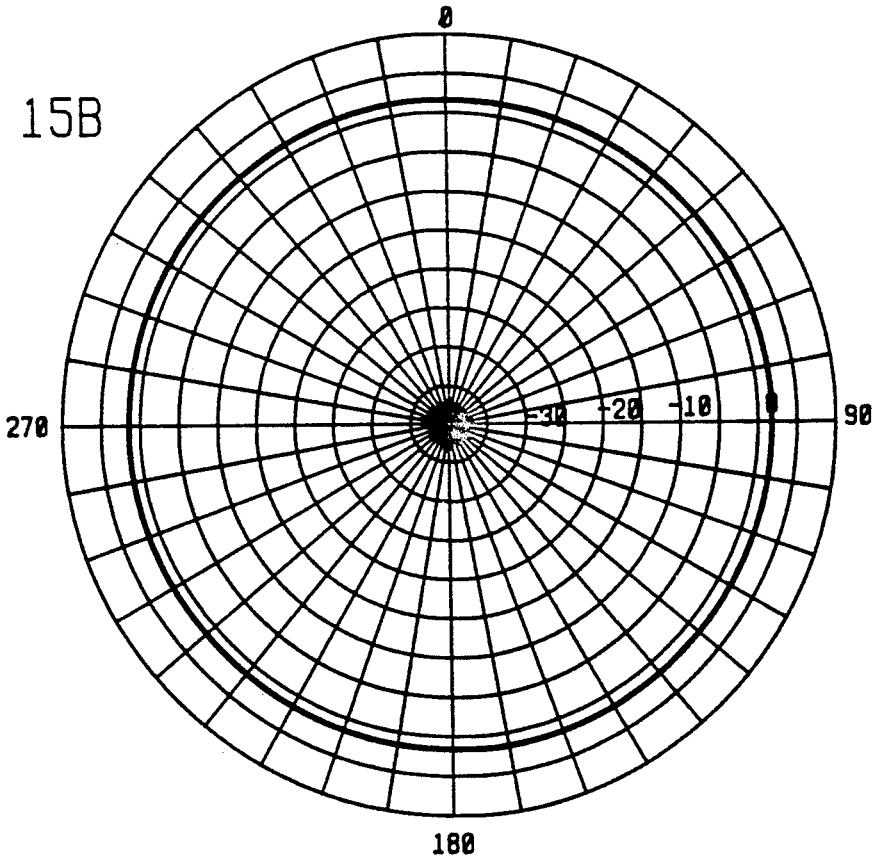

The pattern of FIG. 15A (elevation) and FIG. 15B (azimuth) is distinct from each of the aforementioned patterns because it is a predominantly vertically polarized, low angle beam exhibiting a maximum near the horizon. Simply stated, the four arms of the antenna system 120 are fed in-phase against the fifth radiator 130, which should be positioned along the central axis of the antenna. When the central axis is vertical with respect to the ground plane, the fourth pattern will primarily be vertically polarized and hence orthogonal to the low angle beam pattern generated with input $I_3$.

ADVANTAGES, MODIFICATIONS AND OTHER FEATURES OF THE INVENTION

It has been illustrated that a two-source hybrid circuit can be configured to provide either a zero or 180 degree phase transformation for each input at each of four output ports (A, B, C, D). According to the preferred embodiment configuration the module 10 provides the following phase transformations at the output ports:

(0, 0, PI, PI) when a source is applied across the terminals 12 and 14; and (0, PI, PI, 0) when a source is applied across the terminals 16 and 18.

Hybrid circuits, when formed according to the invention (e.g., using the module 10), provide numerous advantages over other hybrid networks which can simultaneously feed two isolated sources to four outputs. A feature of the invention is the isolation of sources in a four-output hybrid circuit having only 50 Ohm input and output impedances. In contrast, higher impedance (e.g., 300 Ohm) hybrid transformers and baluns, such as the types formed on toroidal-shaped ferrite cores, have been required in order to configure two-input/four-output networks in antenna systems known in the prior art. These high-impedance devices are relatively large, bulky and inefficient in comparison to 100 Ohm transmission line baluns.

According to the invention the compensating circuitry (e.g., the capacitors 60 and 62 and the coil 64) compensate for leakage reactance of the auto-transformer 57. This enables a designer to use the low-impedance broad band auto-transformer 57 in lieu of a relatively high impedance balun for matching the output impedance of the hybrid circuit with the load. With this arrangement the hybrid circuit can be built with the low-impedance transmission line baluns to provide source isolation.

A brief analysis can facilitate a comparison between the size and desirability of the present design with earlier designs based on higher impedance characteristics. Generally, the impedance of a two-wire line is proportional to log (2D/d), where D is the wire spacing and d is the diameter of each wire. For further detail see *Reference Data For Radio Engineers*, International Telephone and Telegraph Co. (1957), p. 588. A comparison of wire spacings required for 300 Ohm and 50 Ohm baluns will help illustrate the advantages of the circuitry disclosed herein over networks formed with high impedance devices.

Assuming a Teflon-insulated two-wire line immersed in oil having a dielectric constant equivalent to that of the Teflon coating (i.e., a relative dielectric constant of 2.1) and assuming use of number 14 gauge wire (d=0.064 inch) in order to handle 10 kW of rf power, a 300 Ohm impedance device would require that the spacing D between wires be 1.2 inches with a total width for the pair of wires being 1.26 inches. Due to this large separation requirement between conductors in the winding, it is quite difficult to wrap, say, 10 turns around a stack of four ferrite cores which are four inches in diameter, without encountering interference between turns.

In contrast, the 100 Ohm baluns that are required by the 50 Ohm module, when formed with number 14 gauge wire, would have a wire spacing of only 0.107 inch. This results in a total width for the pair of wires of 0.171 inch. It is not at all difficult to wrap such closely spaced wires about ferrite cores which are four inches in diameter.

As illustrated with the four-input hybrid circuit structure 70, a network of the two-source hybrid circuit modules 10 can be assembled to provide a larger number of input terminals and a variety of output phase configurations for each of several independent inputs. Generally it is possible to assemble a plurality of the modules 10 by connecting output terminals of one module to input or output terminals of one or more other modules. While not all module combinations will be useful in conjunction with multiarm log spiral antennas, such configurations can be advantageous in transmission systems comprising phased arrays, and can provide antenna systems which isolate/discriminate a large number of incoming signals from one another.

Simultaneous provision of four radiation patterns with the circuit structure 70, e.g., incorporated in the antenna system 100, is consistent with the general principle that N−1 orthogonal modes can be obtained with N orthogonal radiators. Preferably the fifth radiator is formed along a central axis of the antenna. If, for example, the antenna is a conical spiral, the fifth radiator could be the antenna mast, as illustrated in FIG. 13A. Prior to the present invention it was not possible to generate four spatially orthogonal patterns individually or simultaneously with a log spiral antenna. And whereas it was not previously possible to generate two low angle patterns which are spatially orthogonal, two such patterns are available with the circuit structure 70 incorporated in an antenna system.

The module 10 may also be used to form a system wherein an antenna is connected to a number of receivers. The receivers may be tuned to different frequencies. Such a system is known as a receive multicoupler. Obviously it is necessary to isolate the various receivers to minimize harmonics and distortion. In the past such isolation has been effected with resistive networks which, undesirably, attenuate the received signals. Resistive networks also add considerable noise to receive multicoupler networks, thereby degrading the signal-to-noise ratio. Both the signal attenuation and the reduced signal-to-noise ratio resulting from the resistive networks deteriorate the overall performance of the system.

Figure 16A:
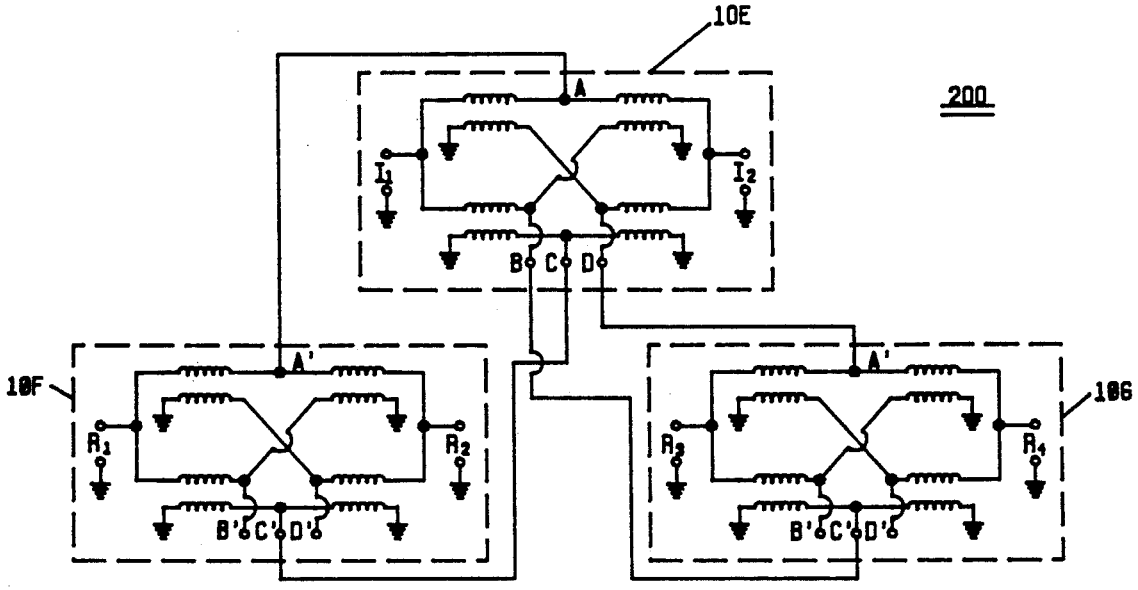
FIGS. 16A, 16B and 16C illustrate a hybrid circuit having one input and four outputs as might be used in a receive multicoupler.

FIG. 16A illustrates a hybrid circuit structure 200 having two inputs I1 and I2 and four outputs. Each input could, for example, be wired to an antenna while each output is coupled to a different receiver. The circuit structure 200 is formed with three of the circuit modules 10, designated 10E, 10F and 10G. The inputs $I_1$ and $I_2$ of the module 10E, and the output terminals $R_1$, $R_2$, $R_3$ and $R_4$ of modules 10F and 10G all correspond to the pairs of input terminals 12, 14 and 16, 18 of the module 10 (FIG. 1). The module 10E includes four output terminals A, B, C and D as designated for the module 10. Modules 10F and 10G each include four output terminals designated A′, B′, C′ and D′ and A″, B″, C″ and D″ which correspond, respectively, to the output terminals A, B, C and D of the modules 10 and 10E. The output terminals A and C of the module 10E are connected to the input terminals A′ and C′, respectively, of the module 10F. The remaining two output terminals of the module 10E, i.e., terminals B and D, are connected to terminals A′ and C′ of the module 10G.

A comparison between the circuit module 10 and each of the circuit modules 10F and 10G makes clear the fact that the input terminals A′, B′, C′ and D′ correspond to the four output terminals A, B, C and D of the modules 10 and 10E. Furthermore, the output terminals $R_1$, $R_2$, $R_3$ and $R_4$ correspond to the input terminals 12, 14, 16 and 18 of the module 10.

Figure 16B:
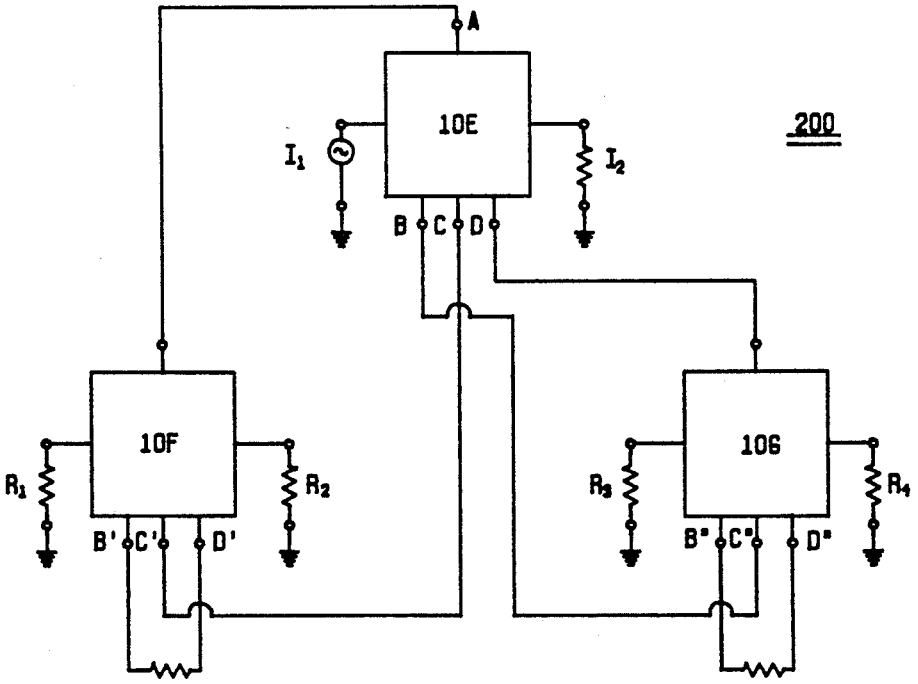

FIG. 16B illustrates the circuit structure 200 with loads tied across the terminals B′ and D′ of each module 10F and 10G. In this configuration, when a source is introduced to the input $I_1$, one half the power is delivered to the module 10F via terminals A and C. The remaining half of the power is delivered to the module 10G via the terminals B and D.

One half the power delivered to the module 10F is available at each of the terminals $R_1$ and $R_2$. Similarly, half the power delivered to the module 10G is available at each of the terminals $R_3$ and $R_4$. All of the output terminals $R_1$, $R_2$, $R_3$ and $R_4$ are rf isolated from one another and can be used independently.

A transmitter may also be connected to the input $I_2$ with the power distributed equally and in phase to the output terminals $R_1$, $R_2$, $R_3$ and $R_4$ for delivery to multiple radiators such as, for example, a phased array of antennas. It is also recognized that with this configuration four transmitters operating at the same frequency and in phase with one another can inject signals of the same magnitude to the terminals each of the terminals $R_1$, $R_2$, $R_3$ and $R_4$ in order to sum the power of four signals at the terminal $I_1$.

Figure 16C:
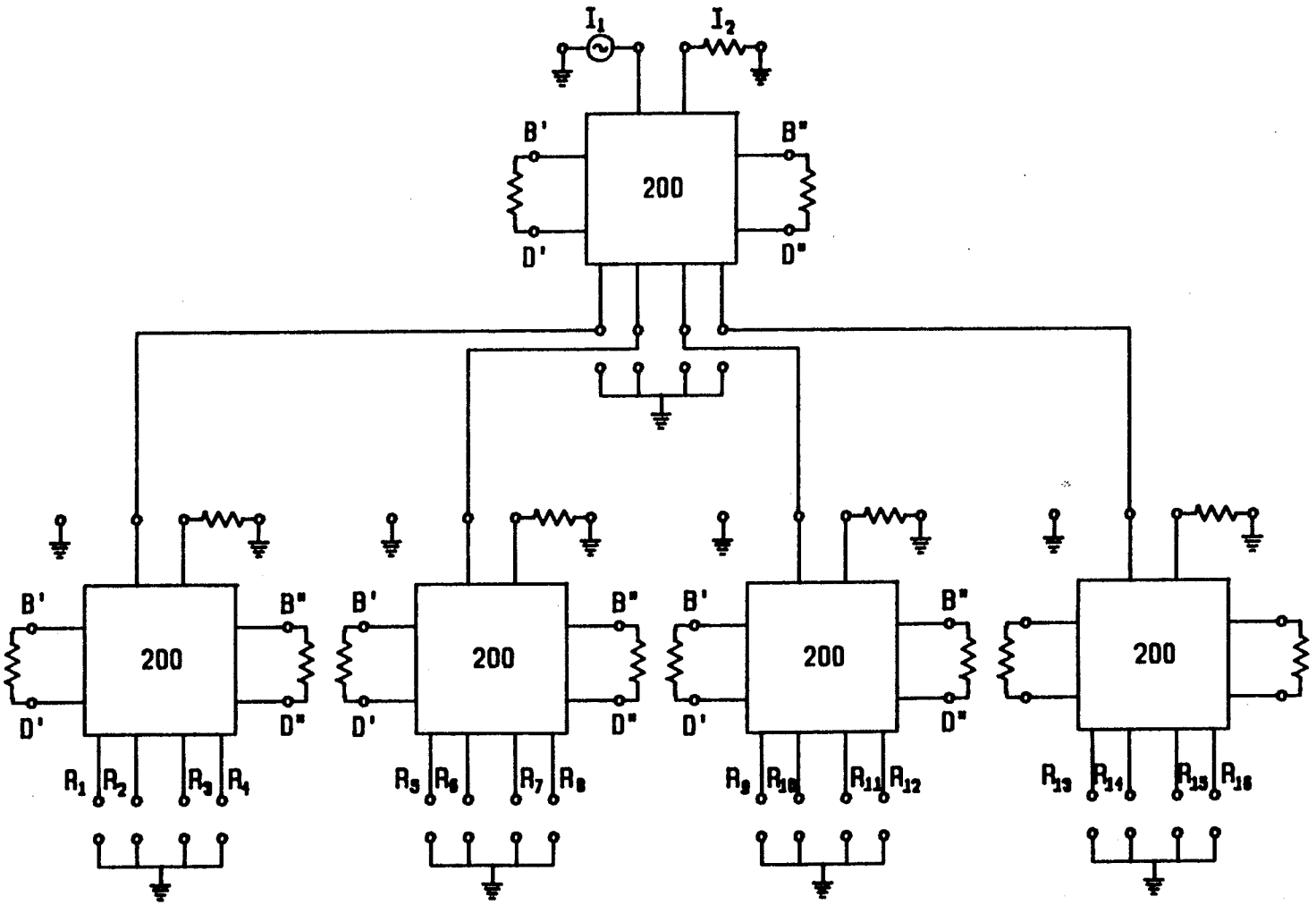

Having described certain preferred embodiments of the invention numerous modifications will likely be apparent to persons skilled in the various arts to which the invention may be applied. For example, multiple modules each corresponding to the circuit structure 200 of FIG. 16A can be arranged to form the multi-input, multi-output port structure of FIG. 16C. Accordingly, the scope of the invention should be understood to be limited only by the claims which follow.

I claim:

1. A hybrid circuit module comprising:

first and second pairs of input terminals;

four output terminals, each for connecting the module to a different load;

and first, second, third and fourth transmission-line baluns connected between the input and output terminals, each balun comprising first and second transmission-line wires of equal length and equal diameter and spaced apart by a constant distance to give a uniform characteristic impedance, and said transmission-line wires being wound on a ferrite core, each transmission-line wire connected in the circuit between one of the input terminals and one of the output terminals so as to isolate signal sources placed across the pairs of first and second input terminals from one another, and wherein the first transmission-line wire of the first balun is connected between a first one of the first pair of input terminals and a first output terminal;

the first transmission-line wire of the second balun is connected between the first one of the first pair of input terminals and a second output terminal;

the first transmission-line wire of the third balun is connected between a first one of the second pair of input terminals and the first output terminal;

the first transmission-line wire of the fourth balun is connected between the first one of the second pair of input terminals and a fourth output terminal;

the second transmission-line wire of the first balun is connected between a second one of the first pair of input terminals and the fourth output terminal;

the second transmission-line wire of the second balun is connected between the second one of the first pair of input terminals and a third output terminal;

the second transmission-line wire of the third balun is connected between a second one of the second pair of input terminals and the second output terminal; and the second transmission-line wire of the fourth balun is connected between the second one of the second pair of input terminals and the third output terminal.

2. The circuit module of claim 1 arranged in a circuit comprising:

four loads, each load including a first terminal for connection to a different one of said four output terminals and a second terminal, said circuit being characterized by an operational frequency range; and four resistive terminations, each connected in series with a different load to extend the circuit operational frequency range, and each termination including a third terminal connected to one of the second load terminals and a fourth terminal for connection with the ground potential.

3. The circuit module of claim 1 and further including four impedance-matching auto-transformers, each auto-transformer including a first terminal connected to a different one of said four output terminals and a second terminal for connection to one of the loads.

4. A method for assembling a plurality of hybrid circuit modules, each module having two pairs of first terminals and four second terminals, so as to form a network comprising N input terminals and M output terminals, comprising the steps of:

introducing a signal across a pair of first terminals in a first module; and connecting the first terminals of a first group of modules to the first terminals of a second group of modules, to impart a desired phase transformation to a signal at one or more second terminals in the second group of modules after the signal has been introduced across a pair of first terminals in the first module.

5. The method of claim 4 wherein the desired phase transformation is 180 degrees.

6. An antenna system comprising a first hybrid circuit module configured to simultaneously generate at least two independent radiation patterns, said circuit module including:

first and second pairs of input terminals;

four output terminals, each terminal for connecting the module to a load; and first, second, third and fourth transmission-line baluns connected between the input and output terminals, each balun comprising first and second transmission-line wires of equal length and equal diameter and spaced apart by a constant distance to give a uniform characteristic impedance, and said transmission-line wires being wound on a ferrite core, each transmission-line wire being connected in the circuit between one of the input terminals and one of the output terminals so as to isolate signal sources placed across the pairs of first and second input terminals from one another, wherein:

the first transmission-line wire of the first balun is connected between a first one of the first pair of input terminals and a first output terminal;

the first transmission-line wire of the second balun is connected between the first one of the first pair of input terminals and a second output terminal;

the first transmission-line wire of the third balun is connected between a first one of the second pair of input terminals and the first output terminal;

the first transmission-line wire of the fourth balun is connected between the first one of the second pair of input terminals and fourth output terminal;

the second transmission-line wire of the first balun is connected between a second one of the first pair of input terminals and the fourth output terminal;

the second transmission-line wire of the second balun is connected between the second one of the first pair of input terminals and a third output terminal;

the second transmission-line wire of the third balun is connected between a second one of the second pair of input terminals and the second output terminal; and the second transmission-line wire of the fourth balun is connected between the second one of the second pair of input terminals and the third output terminal, said antenna system further including:

a plurality of radiators, each radiator configurable in combination with the other radiators to form a multi-arm rotationally symmetric equiangular spiral antenna, each radiator including a first terminal for connecting the respective radiator to a corresponding one of the module output terminals and a second terminal for connecting the respective radiator in combination with said module to a reference potential in order to provide the load for each corresponding output terminal and form a complete circuit, whereby the module can feed each radiator in order to generate said radiation patterns.

7. The antenna system of claim 6 wherein each radiator provides an identical load for a different module output terminal, and all of said second terminals are spatially positioned to define a plane.

8. The antenna system of claim 7 wherein:

one of the input terminals in each pair is for connecting said module to a reference potential; and four radiators are each arranged in a spiral configuration with their second terminals spatially positioned to define the plane, said system further including a fifth radiator having an orthogonal orientation with respect to the plane and electrically coupled between said reference potential input terminals and the second terminals of said four radiators.

9. The antenna system of claim 8 wherein the fifth radiator is electrically wired between the second terminals of said four radiators and said reference potential input terminals.

10. The antenna system of claim 8 wherein the fifth radiator is electromagnetically coupled with each of said four other radiators.

11. The antenna system according to claim 6 wherein the plurality of radiators are arranged to form a planar log-spiral antenna.

12. The antenna system according to claim 6 wherein the plurality of radiators are arranged to form a multi-arm conical log-spiral antenna.

13. The antenna system according to claim 6 wherein the system operates at frequencies between 2 and 30 MHz.

14. A method for feeding a multi-arm antenna structure with a multi-port network, wherein the structure comprises conical-spiral arms formed along a central axis of symmetry, and the antenna arms each include first and second terminals, with the first antenna terminals being connected to said network, the method comprising the step of:

connecting a radiating conductive path along the central axis of symmetry between the second terminal of each arm and said multi-port network, thereby forming a circuit path.

15. A quad-mode hybrid circuit comprising:

four circuit modules arranged to provide four pairs of first hybrid terminals and four hybrid output terminals, each hybrid output terminal for connection to a load, each of the modules including:

first and second pairs of input terminals;

four output terminals, each connectable to a different load; and first, second, third and fourth transmission-line baluns connected between the input and output terminals, each balun comprising first and second transmission-line wires, each transmission-line wire being connected in the circuit between one of the input terminals and one of the output terminals so as to isolate signal sources placed across the pairs of first and second input terminals from one another, and:

wherein the output terminals associated with different modules are connected with one another to interconnect all of the modules; and wherein for first and second ones of the four modules, each pair of input terminals serves as one pair of said first hybrid terminals; and wherein each first hybrid terminal pair is wired in combination with corresponding baluns to provide rf signal source isolation with respect to the other pairs of first hybrid terminals; and wherein for third and fourth ones of the four modules, one in each pair of input terminals serves as one of the hybrid output terminals;

and wherein for each module:

a first transmission-line wire of the first balun is connected between a first one of the first pair of input terminals and a first output terminal;

a first transmission-line wire of the second balun is connected between the first one of the first pair of input terminals and a second output terminal;

a first transmission-line wire of the third balun is connected between a first one of the second pair of input terminals and the first output terminal;

a first transmission-line wire of the fourth balun is connected between the first one of the second pair of input terminals and a fourth output terminal;

a second transmission-line wire of the first balun is connected between a second one of the first pair of input terminals and the fourth output terminal;

a second transmission-line wire of the second balun is connected between the second one of the first pair of input terminals and a third output terminal;

a second transmission-line wire of the third balun is connected between a second one of the second pair of input terminals and the second output terminal; and a second transmission-line wire of the fourth balun is connected between the second one of the second pair of input terminals and the third output terminal.

16. The hybrid circuit of claim 15 wherein all of the first hybrid terminals exhibit about 30 dB of electrical isolation with respect to one another, and all of the hybrid output terminals are coupled to an identical resistive load.

17. A quad-mode hybrid circuit comprising first, second, third and fourth circuit modules, each of which includes:

first and second pairs of input terminals;

four output terminals, each connectable to a different load; and first, second, third and fourth transmission-line baluns connected between the input and output terminals, each balun comprising first and second transmission-line wires, each transmission-line wire being connected in the circuit between one of the input terminals and one of the output terminals so as to provide rf signal isolation between the first and second pairs of input terminals, wherein:

each of the output terminals associated with the first and second modules is connected to one of the output terminals associated with the third and fourth modules to interconnect all of the modules;

and the input terminals of the first and second modules serve as four pairs of hybrid input terminals for receiving four signals in isolation from one another;

and the input terminals of the third and fourth modules serve as four other hybrid terminals for connection to a load.

18. The quad-mode hybrid circuit of claim 17 wherein:

each pair of hybrid input terminals is capable of receiving different electrical signals from loads connected to the four other hybrid terminals; and the pairs of hybrid input terminals are in substantial electrical isolation with respect to one another over a range of frequencies.

19. The quad-mode hybrid circuit of claim 17 wherein all of the hybrid input terminals exhibit substantial electrical isolation with respect to one another over a broad range of radio frequencies.

20. The quad-mode hybrid circuit of claim 17 wherein:

all of the hybrid input terminals exhibit about 30 dB of electrical isolation with respect to one another over the frequency range extending from 2 to 30 MHz; and all of the hybrid output terminals exhibit about 30 dB of electrical isolation with respect to one another over the frequency range extending from 2 to 30 MHz.

21. A method for feeding a multi-arm antenna structure with a hybrid circuit network wherein the antenna structure includes at least four radiating arms, each arm having first and second terminals, with the first terminals being connected to said network, the method comprising the steps of:

coupling all of the second terminals of said at least four radiating arms to one another;

providing an additional radiating arm which has first and second terminals;

coupling the first terminal of the additional radiating arm to the first terminals of said at least four radiating arms; and coupling all of the second terminals of said at least four radiating arms to the second terminal of the additional radiating arm, such that the second terminals of said at least four radiating arms are coupled to said network through the additional radiating arm.

22. The method of claim 21 and further including the steps of:

symmetrically positioning the additional radiating arm with respect to said at least four radiating arms; and physically connecting the additional radiating arm for electrical conduction between the second terminals of said at least four radiating arms and said network.

23. The method of claim 21 and further including the step of:

electromagnetically coupling the second terminals of said at least four radiating arms to the second terminal of the additional radiating arm.

24. The method of claim 23 further including the step of providing four independent signals to said network to radiate four different radiation patterns.

25. The method of claim 24 wherein the four independent signals are simultaneously provided to said network to radiate four independent radiation patterns.

26. A multi-port network of the type used to feed a multi-arm antenna, comprising:

four pairs of first network terminals;

four second network terminals; and a plurality of constant-impedance transmission-line baluns, each balun comprising a winding formed with a pair of wires having finite lengths, and said wires being equally spaced apart for at least a portion of their lengths, each wire being connected between respective ones of the first and respective ones of the second network terminals, said baluns rendering the pairs of first terminals rf isolated from one another and the second terminals rf isolated from one another, and each second terminal being connected to an identical load to form a complete circuit.

27. The network of claim 26 wherein the baluns are arranged and interconnected to form a plurality of circuit modules, each having a predetermined characteristic impedance, wherein:

all of the modules have the same impedance characteristics;

each circuit module includes two pairs of first module terminals, four second module terminals, and at least four of the baluns, with the second terminals of different modules being connected to one another, and the baluns within each module being configured to isolate sources placed across the pairs of first terminals from one another;

four pairs of first module terminals associated with first and second ones of the plurality of modules serve as first network terminals; and four first module terminals associated with third and fourth ones of the plurality of modules serve as the second network terminals.

28. The network of claim 27 wherein the second module terminals associated with a first pair of the modules are coupled to the second module terminals associated with a second pair of the modules.

29. The network of claim 28 wherein the first terminals associated with the second pair of modules include the four isolated second terminals of the multi-port network.

30. The network of claim 27 wherein distinct rf sources are placed across different pairs of first network terminals, and wherein each module comprises a total of four interconnected baluns configured in the circuit to isolate the rf signal sources from one another.

31. The network of claim 30 wherein the pairs of first module terminals are module input terminals, and the second module terminals are module output terminals and for each module:

a first transmission wire of the first balun is connected between a first one of the first pair of input terminals and a first output terminal;

a first transmission wire of the second balun is connected between the first one of the first pair of input terminals and a second output terminal;

a first transmission wire of the third balun is connected between a first one of the second pair of input terminals and the first output terminal; and a first transmission wire of the fourth balun is connected between the first one of the second pair of input terminals and a fourth output terminal.

32. The network of claim 31 wherein for each module:

a second transmission wire of the first balun is connected between a second one of the first pair of input terminals and the fourth output terminal;

a second transmission wire of the second balun is connected between the second one of the first pair of input terminals and a third output terminal;

a second transmission wire of the third balun is connected between a second one of the second pair of input terminals and the second output terminal; and a second transmission wire of the fourth balun is connected between the second one of the second pair of input terminals and the third output terminal.

33. An antenna system for simultaneously providing at least two independent radiation patterns, comprising:

a plurality of radiators and a hybrid circuit structure, said radiators arranged to form a multi-arm antenna, each arm including a first terminal connected to the hybrid circuit structure and a second terminal connected to a reference potential, the hybrid circuit structure having a plurality of input terminals arranged in pairs for receiving multiple rf input signals in substantial electrical isolation from one another, said structure including four output terminals, wherein each of said output terminals provides connection with the first terminal of a different radiator for simultaneously feeding the radiators with each of the multiple input signals, said structure further including constant-impedence transmission-line balun means operatively connected with said input and output terminals for rendering the pairs of input terminals rf isolated from one another and for rendering the output terminals rf isolated from one another.

34. The system of claim 33 wherein said circuit structure includes four pairs of input terminals.

35. The system of claim 33 wherein the radiators are arranged to form a log-periodic antenna and each radiator provides an identical load between a respective output terminal and the reference potential.

36. The system of claim 33 wherein there are four radiators, each arranged as an arm of a spiral antenna.

37. The system of claim 36 wherein the four radiators are arranged to form an equiangular conical spiral antenna.

38. The antenna system of claim 33 wherein said radiators are connected to said structure to form a complete circuit so that the system will generate radiation patterns, and wherein said balun means comprises a plurality of baluns, each balun having a pair of transmission wires equally spaced apart for at least a portion of their lengths and wrapped on a ferrite core, each one of the wires in each pair carrying a current substantially equal in magnitude and opposite in phase with respect to the other wire in the pair.

39. The antenna system of claim 38 configured to simultaneously transmit multiple radiation patterns, wherein said baluns are formed with a two-wire line coated with an insulative layer having a characteristic dielectric constant and immersed in an oil having a dielectric constant equivalent to that of the characteristic dielectric constant of the insulative coating to provide 100 Ohm devices.

40. The system of claim 38 wherein there are four pairs of input terminals, each for receiving a different one of four independent rf input signals, said balun means configured with respect to the input terminals and the radiators for simultaneously transmitting four independent radiation patterns.

41. The system of claim 40 wherein the patterns include two high-angle patterns and one low-angle pattern.

42. The system of claim 40 wherein the multi-arm antenna is formed about a central axis with respect to a ground plane and a fourth pattern is a low-angle pattern that is a distinct mode with respect to each of the other patterns, and the fourth pattern is predominantly vertically polarized with respect to the ground plane when the central axis of the system is vertical with respect to a ground plane.

* * * * *